US011372361B2

(12) United States Patent
Kojima et al.

(10) Patent No.: US 11,372,361 B2
(45) **Date of Patent: *Jun. 28, 2022**

(54) IMAGE FORMING UNIT AND IMAGE FORMING APPARATUS

(71) Applicant: TOSHIBA TEC KABUSHIKI KAISHA, Tokyo (JP)

(72) Inventors: Takahiro Kojima, Shizuoka (JP); Toshihiro Matsushima, Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/242,826

(22) Filed: Apr. 28, 2021

(65) Prior Publication Data

US 2021/0247715 A1 Aug. 12, 2021

Related U.S. Application Data

(63) Continuation of application No. 16/785,128, filed on Feb. 7, 2020, now Pat. No. 11,022,926.

(30) Foreign Application Priority Data

Mar. 22, 2019 (JP) ..... JP2019-055496
Dec. 3, 2019 (JP) ..... JP2019-218802

(51) Int. Cl.
*G03G 15/00* (2006.01)

(52) U.S. Cl.
CPC ..... *G03G 15/751* (2013.01)

(58) Field of Classification Search
CPC ..... G03G 15/751
See application file for complete search history.

(56) References Cited

U.S. PATENT DOCUMENTS

| | | | |
|---|---|---|---|
| 2008/0152386 | A1 | 6/2008 | Sakaguchi et al. |
| 2009/0142092 | A1 | 6/2009 | Sato |
| 2009/0190953 | A1 | 7/2009 | Okabe |
| 2011/0299873 | A1 | 12/2011 | Ushiozu et al. |
| 2012/0183319 | A1 | 7/2012 | Sato et al. |
| 2013/0259516 | A1 | 10/2013 | Ikeda et al. |
| 2016/0342106 | A1 | 11/2016 | Kono |

FOREIGN PATENT DOCUMENTS

JP 2008-020845 A 1/2008

OTHER PUBLICATIONS

Extended European Search Report issued in European Patent Application No. 20162142.2 dated Sep. 11, 2020, eight (8) pages.
Non-Final Office Action on U.S. Appl. No. 16/785,128 dated Sep. 16, 2020.
Notice of Allowance on U.S. Appl. No. 16/785,128 dated Jan. 29, 2021.

*Primary Examiner* — Gregory H Curran
(74) *Attorney, Agent, or Firm* — Foley & Lardner LLP

(57) ABSTRACT

An image forming unit insertable into an image forming apparatus includes a photosensitive drum and a drum case supporting the photosensitive drum. The drum case includes a guide configured to (i) at least partially engage with a solid head of the image forming apparatus when inserted into the image forming apparatus along a first direction and (ii) guide the solid head in a second direction orthogonal to the first direction when the solid head is selectively repositioned along the second direction toward the photosensitive drum.

20 Claims, 28 Drawing Sheets

IMAGE FORMING UNIT AND IMAGE FORMING APPARATUS

CROSS-REFERENCE TO RELATED APPLICATIONS

This application is a continuation of U.S. application Ser. No. 16/785,128 filed Feb. 7, 2020, which is based upon and claims the benefit of priority from Japanese Patent Application No. 2019-055496, filed Mar. 22, 2019 and Japanese Patent Application No. 2019-218802, filed Dec. 3, 2019, the entire contents of which are hereby incorporated by reference.

FIELD

Embodiments described herein relate generally to an image forming unit and an image forming apparatus.

BACKGROUND

In an image forming apparatus such as an electrophotographic apparatus, a technique in which a photosensitive drum of an image forming unit is exposed by an exposure device including a solid head, a developer such as a toner is adhered to the photosensitive drum, and the developer is transferred to a sheet such as paper is known.

When cleaning the solid head, replacing the image forming unit or the like, the solid head is located at a position away from the photosensitive drum. When image formation is performed, the solid head abuts on the image forming unit and is located at a predetermined position with respect to the photosensitive drum. In order to set a relative position of the solid head and the photosensitive drum to a predetermined position, the solid head and the image forming unit need to be positioned. For that reason, the solid head and the image forming unit have a protruding body and an opening, and the protruding body is inserted into the opening to guide the relative position of the solid head and the image forming unit.

In such an image forming apparatus, the image forming unit is inserted into a frame of the image forming apparatus such that the solid head abuts the image forming unit. However, when the image forming unit and the solid head are disposed, if the positions of the protruding body and the opening are deviated from each other, the protruding body may not be inserted into the opening and the solid head and the image forming unit may not be positioned.

DETAILED DESCRIPTION

Figure 1:
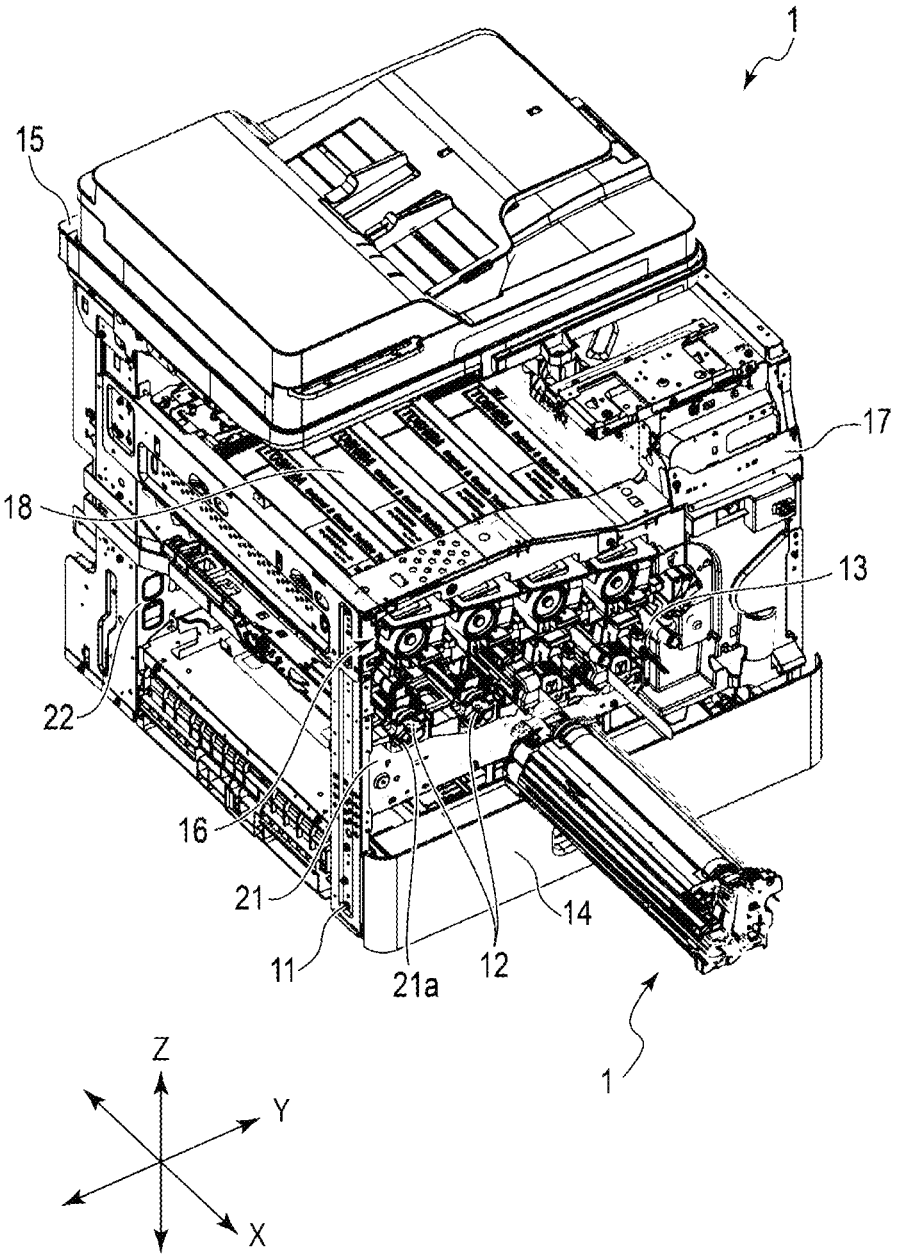
FIG. 1 is a perspective view illustrating a configuration of an image forming apparatus according to an embodiment.

A problem to be solved by an exemplary embodiment is to provide an image forming unit and an image forming apparatus capable of guiding a relative positional relationship between a solid head and an image forming unit.

In general, according to an embodiment, an image forming unit can be inserted in one direction for mounting to an image forming apparatus provided with a solid head that rises and falls. The image forming unit includes a photosensitive drum, a drum case, and a guide. The photosensitive drum is disposed at a predetermined position with respect to the solid head. The drum case supports the photosensitive drum. The guide is provided in the drum case, and guides the solid head in a direction orthogonal to the one direction and an elevating direction when the solid head rises and falls toward the photosensitive drum.

Hereinafter, an image forming apparatus 1 including an image forming unit 13 according to an embodiment will be described with reference to FIGS. 1 to 26.

In the embodiment, the image forming apparatus 1 will be described below assuming that a direction along an insertion direction of the image forming unit 13 is the X-direction, a direction along a gravity direction is the Z-direction, and a direction orthogonal to the X-direction and the Z-direction is the Y-direction. The image forming apparatus 1 will be described assuming that the X-direction is the front-and-rear direction and a side on which the image forming unit 13 is inserted is the front side. The X-direction is also an axial direction of a photosensitive drum 52 when the image forming unit 13 is disposed in a frame 11 and mounted to a solid head unit 12.

Figure 2:
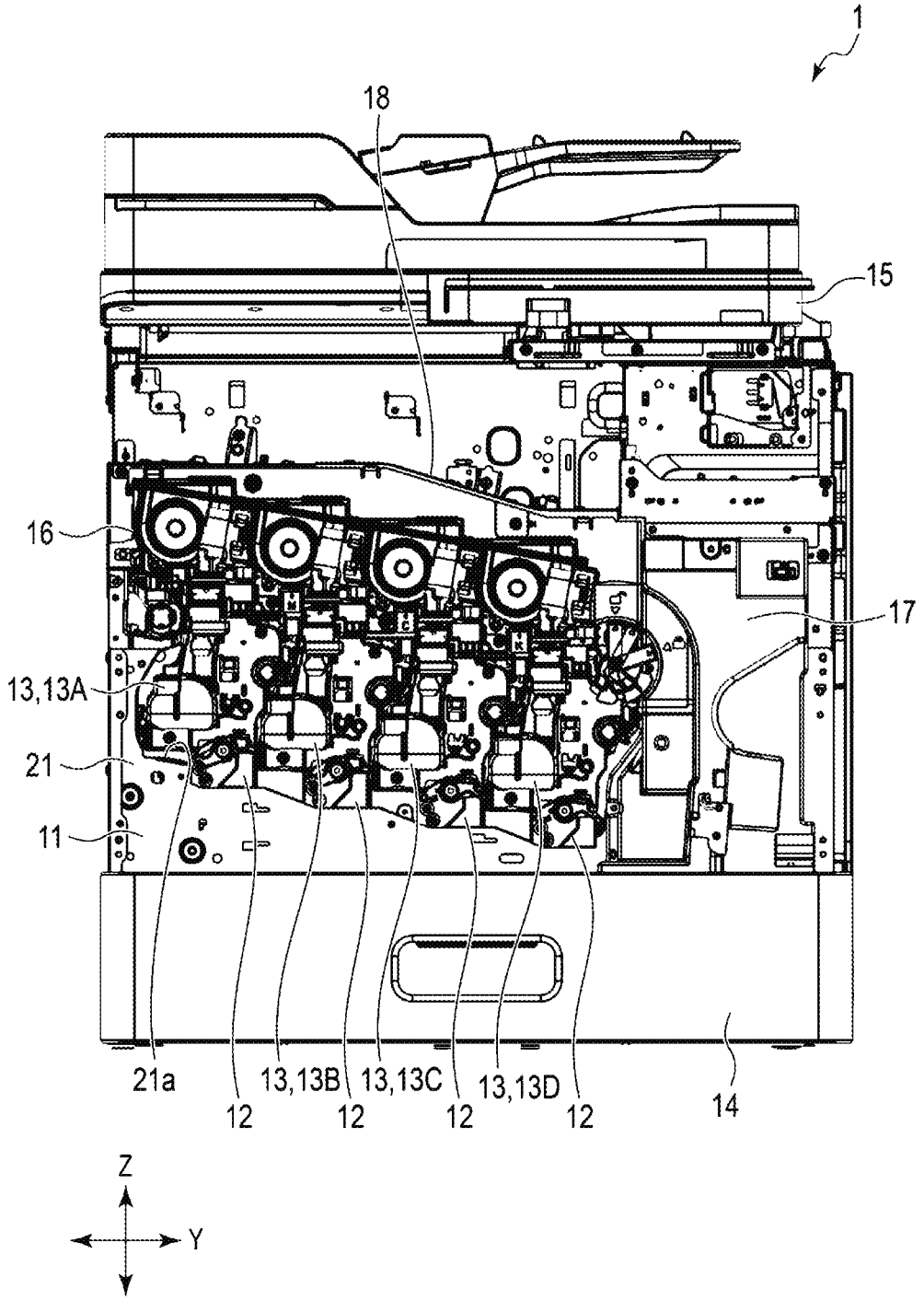
FIG. 2 is a front view illustrating the configuration of the image forming apparatus.
Figure 3:
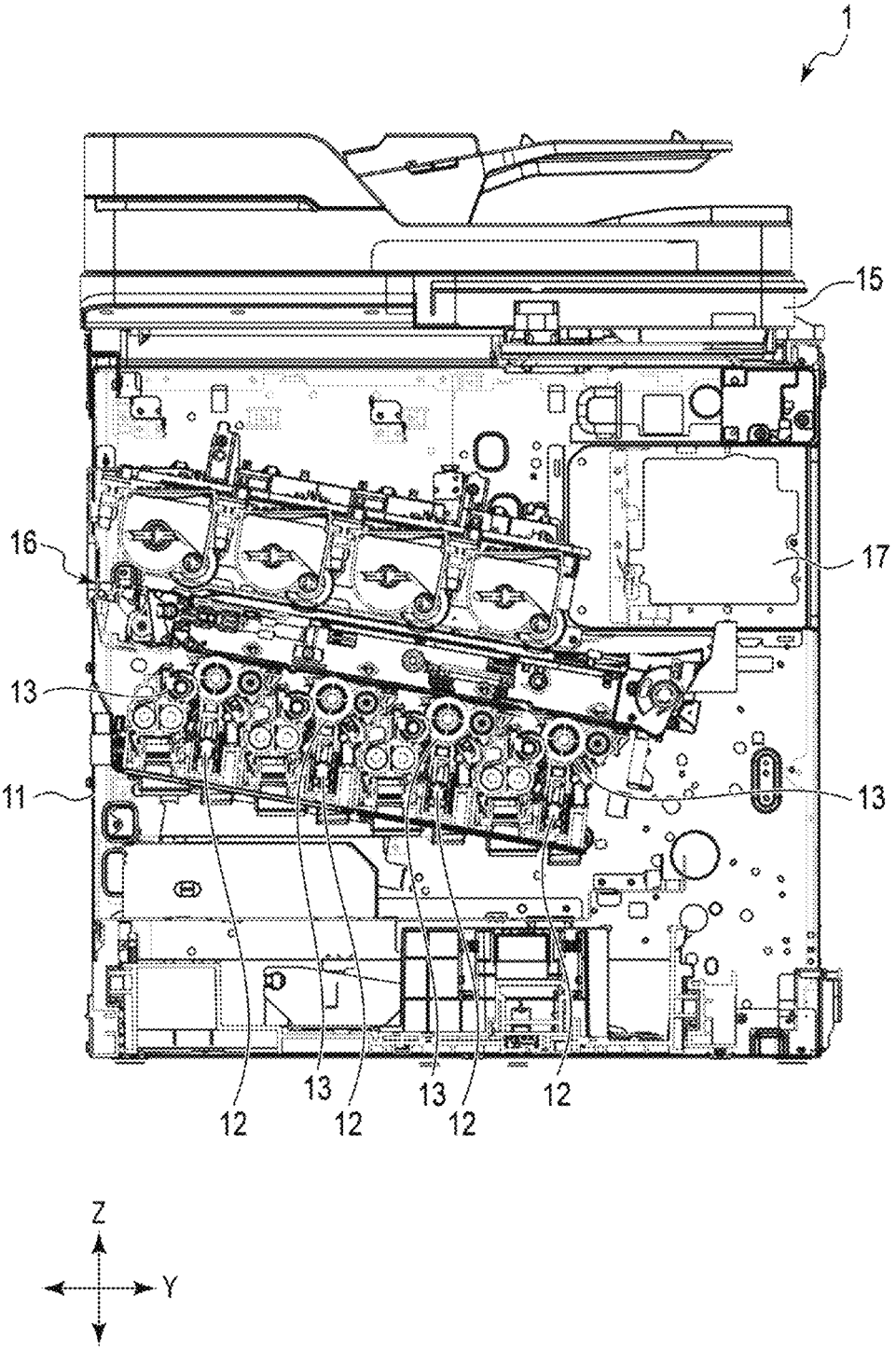
FIG. 3 is a cross-sectional view illustrating the configuration of the image forming apparatus when viewed from the front side.
Figure 4:
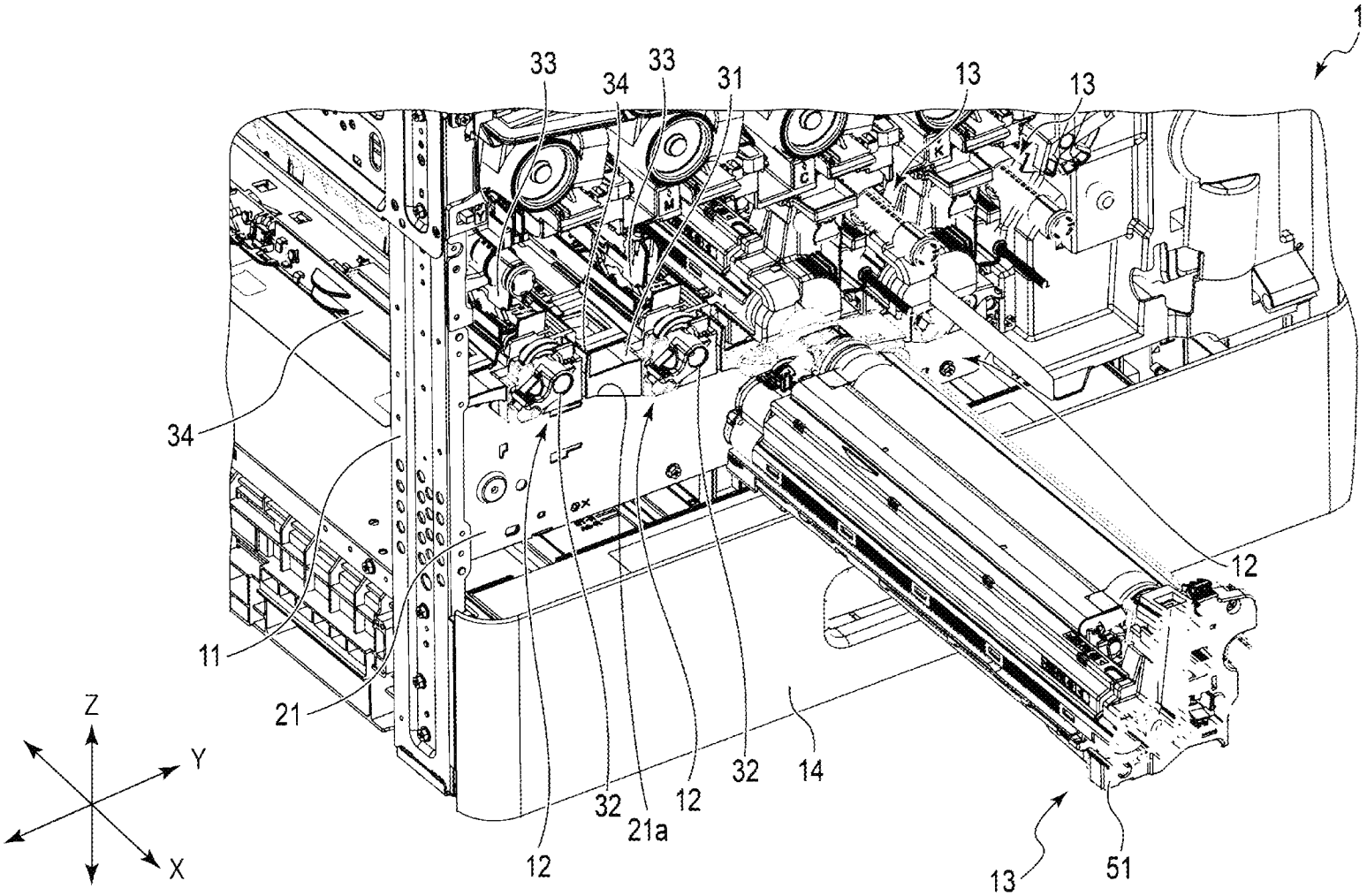
FIG. 4 is a perspective view illustrating a configuration of main portions of the image forming apparatus.
Figure 5:
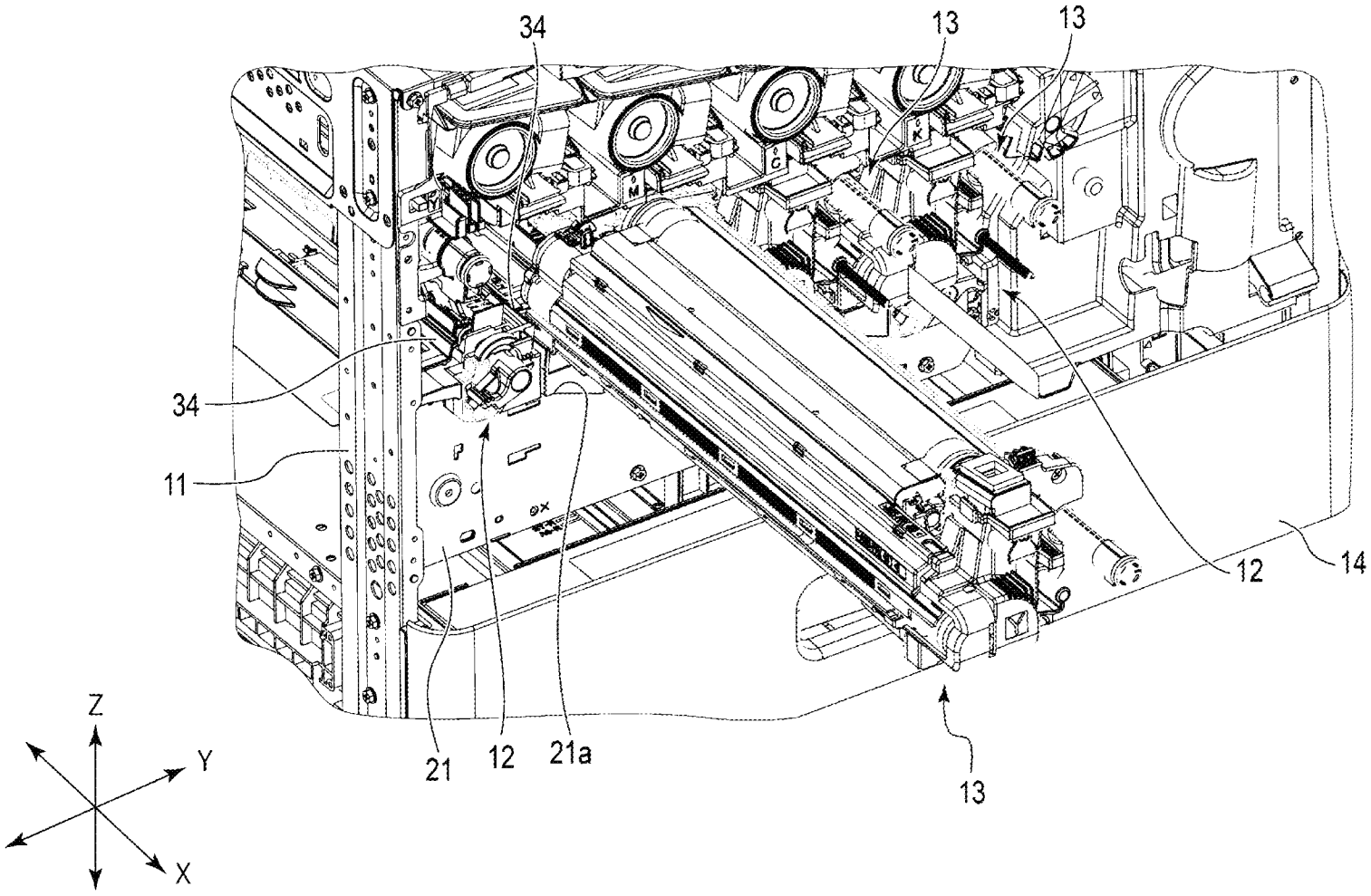
FIG. 5 is another perspective view illustrating the configuration of the main portions of the image forming apparatus.

FIGS. 1 to 3 illustrate a configuration of the image forming apparatus 1 in a perspective view, a front view, and a cross-sectional view, respectively. In FIGS. 1 to 3, a decorative plate used in the image forming apparatus 1 is omitted. FIGS. 4 and 5 are perspective views illustrating a configuration of main portions of the image forming apparatus 1. FIG. 4 illustrates a state where the image forming unit 13 is taken out from the frame 11, and FIG. 5 illustrates a state where the image forming unit 13 is inserted into the frame 11.

Figure 6:
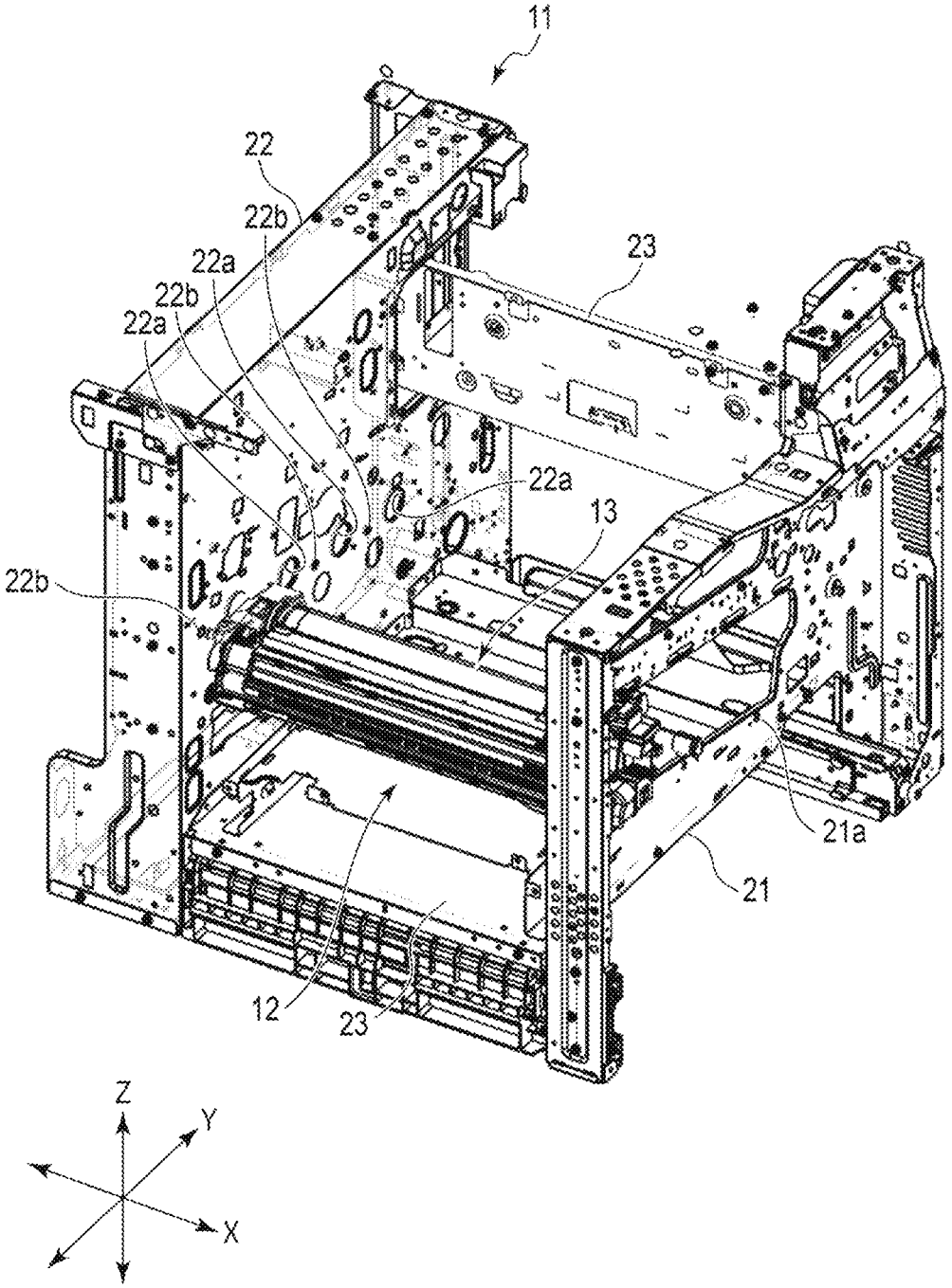
FIG. 6 is a perspective view illustrating a configuration of a frame, a solid head unit, and an image forming unit used in the image forming apparatus.
Figure 7:
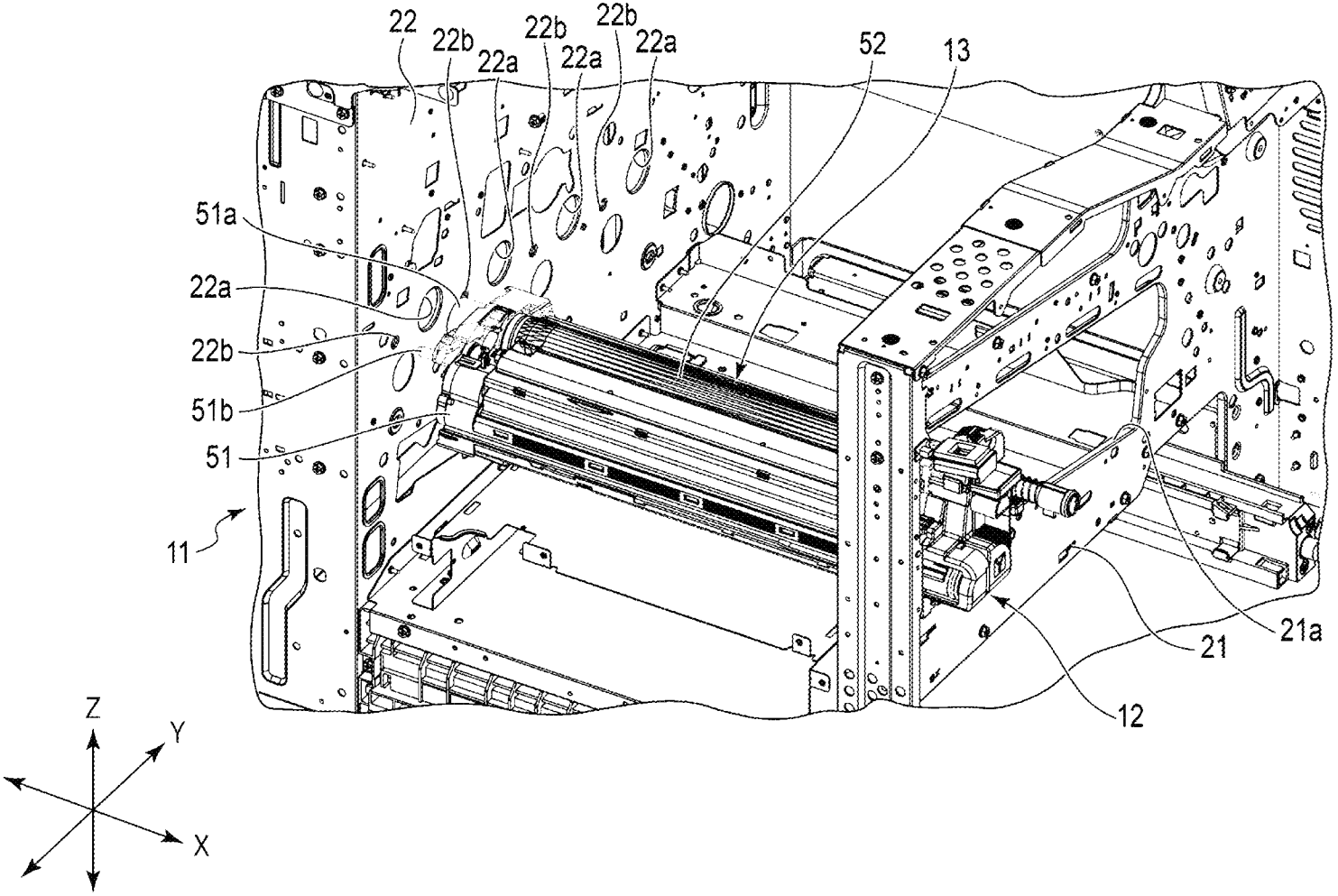
FIG. 7 is a perspective view illustrating a configuration of main portions of the frame, the solid head unit, and the image forming unit.

FIGS. 6 and 7 are perspective views illustrating configurations of the frame 11, the solid head unit 12, and the image forming unit 13 used in the image forming apparatus 1, and FIG. 7 illustrates the main portions in an enlarged manner. In FIGS. 6 and 7, only one solid head unit 12 and one image forming unit 13 are illustrated for convenience of explanation.

Figure 8:
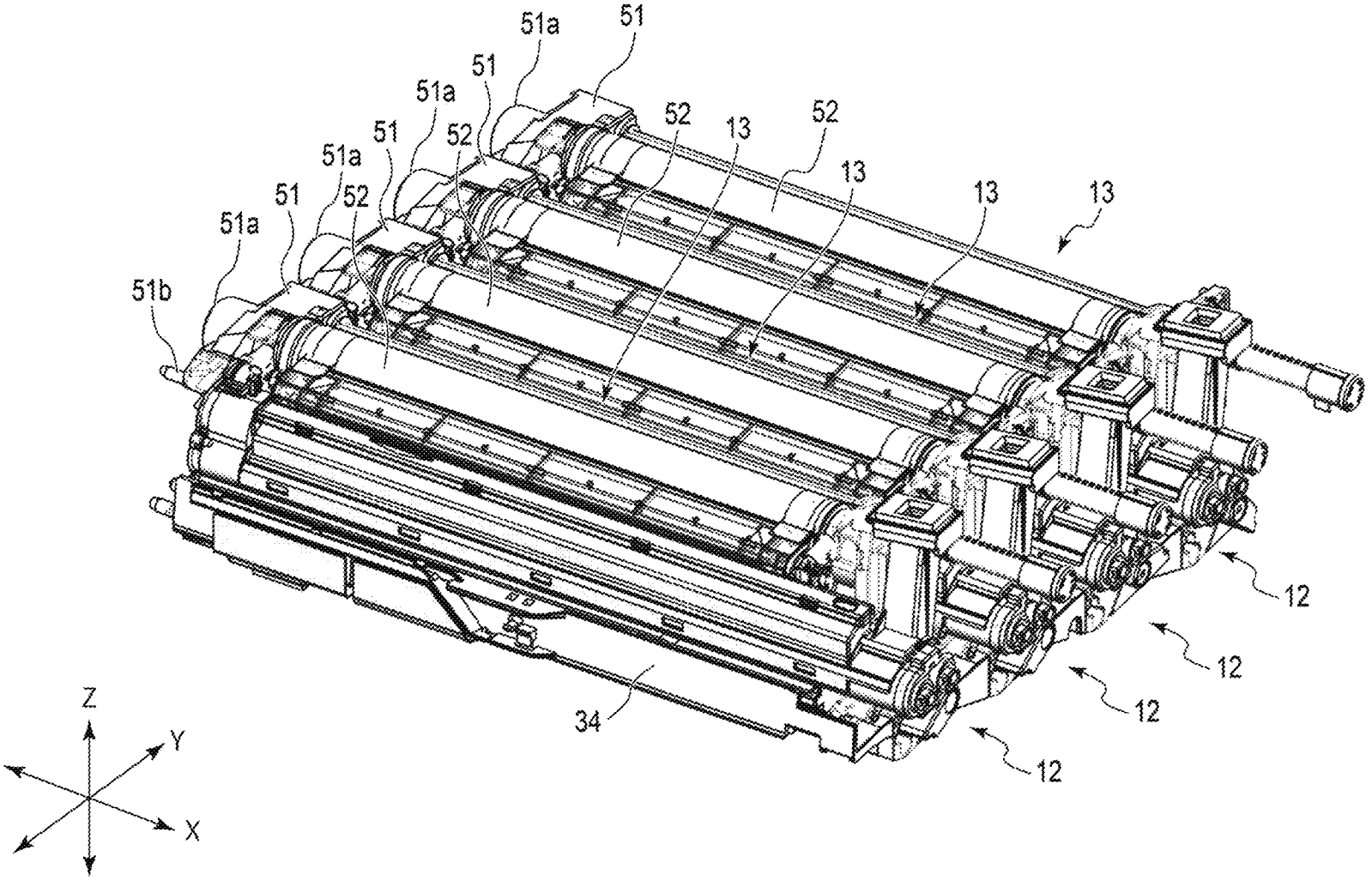
FIG. 8 is a perspective view illustrating a configuration of the solid head unit and the image forming unit.
Figure 9:
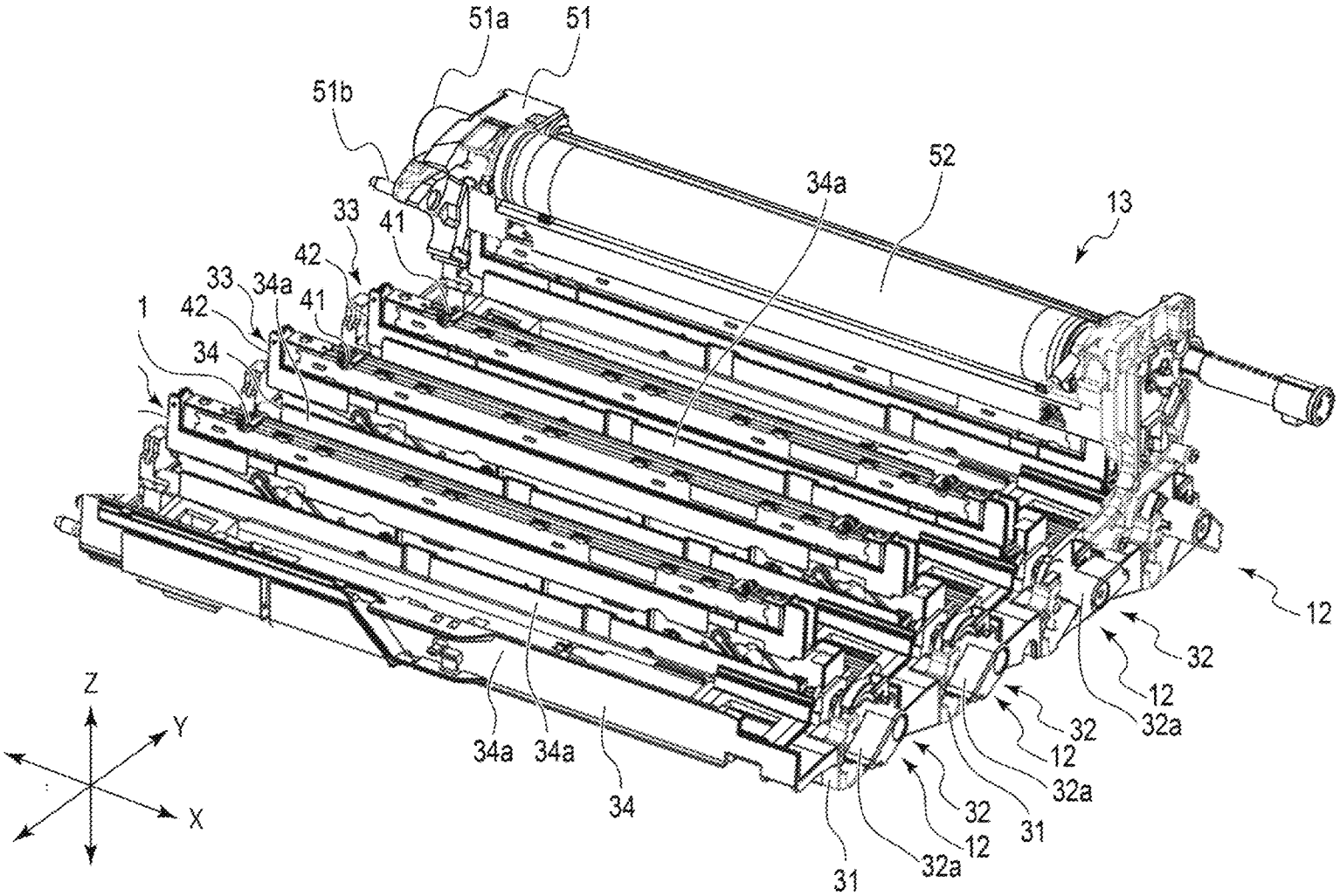
FIG. 9 is another perspective view illustrating the configuration of the solid head unit and the image forming unit.
Figure 10:
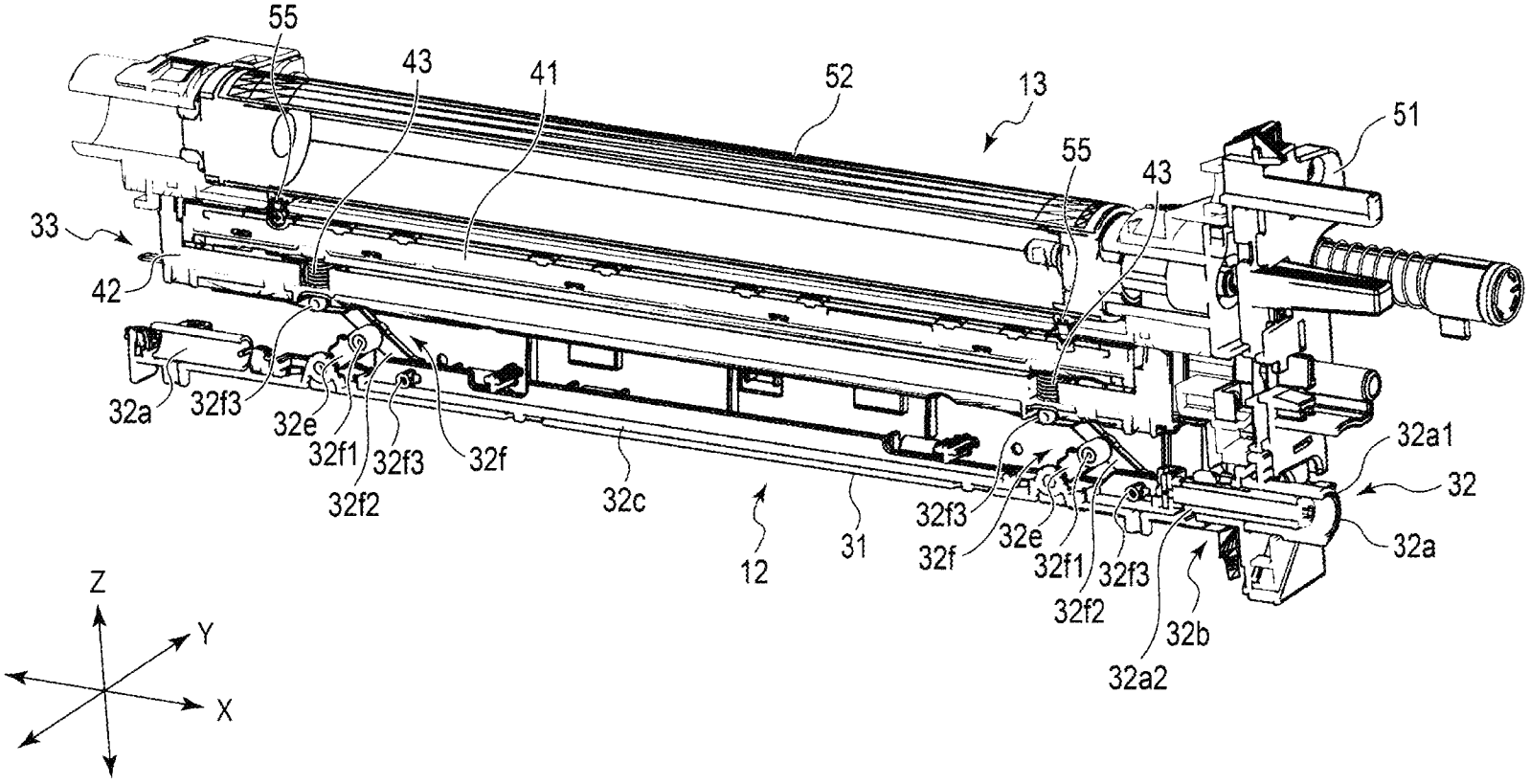
FIG. 10 is another perspective view illustrating the configuration of the solid head unit and the image forming unit.
Figure 11:
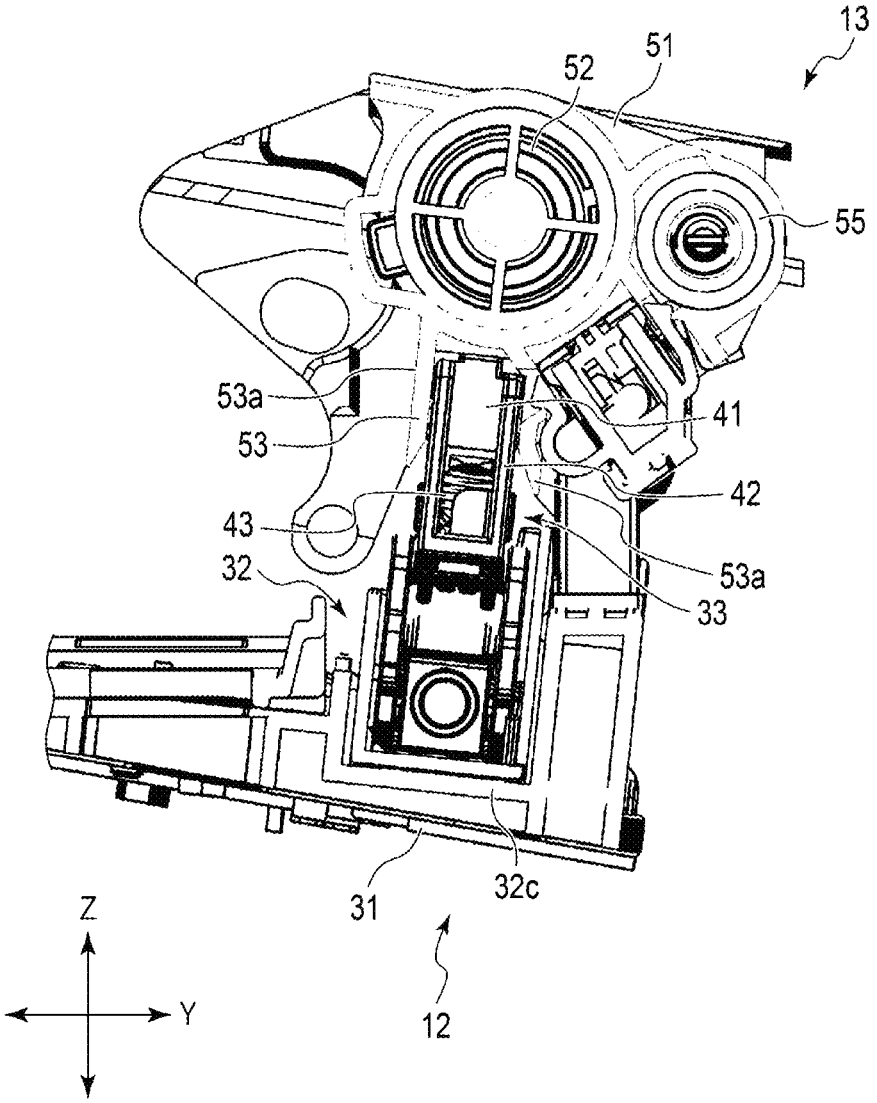
FIG. 11 is a cross-sectional view illustrating the configuration of the solid head unit and the image forming unit.
Figure 12:
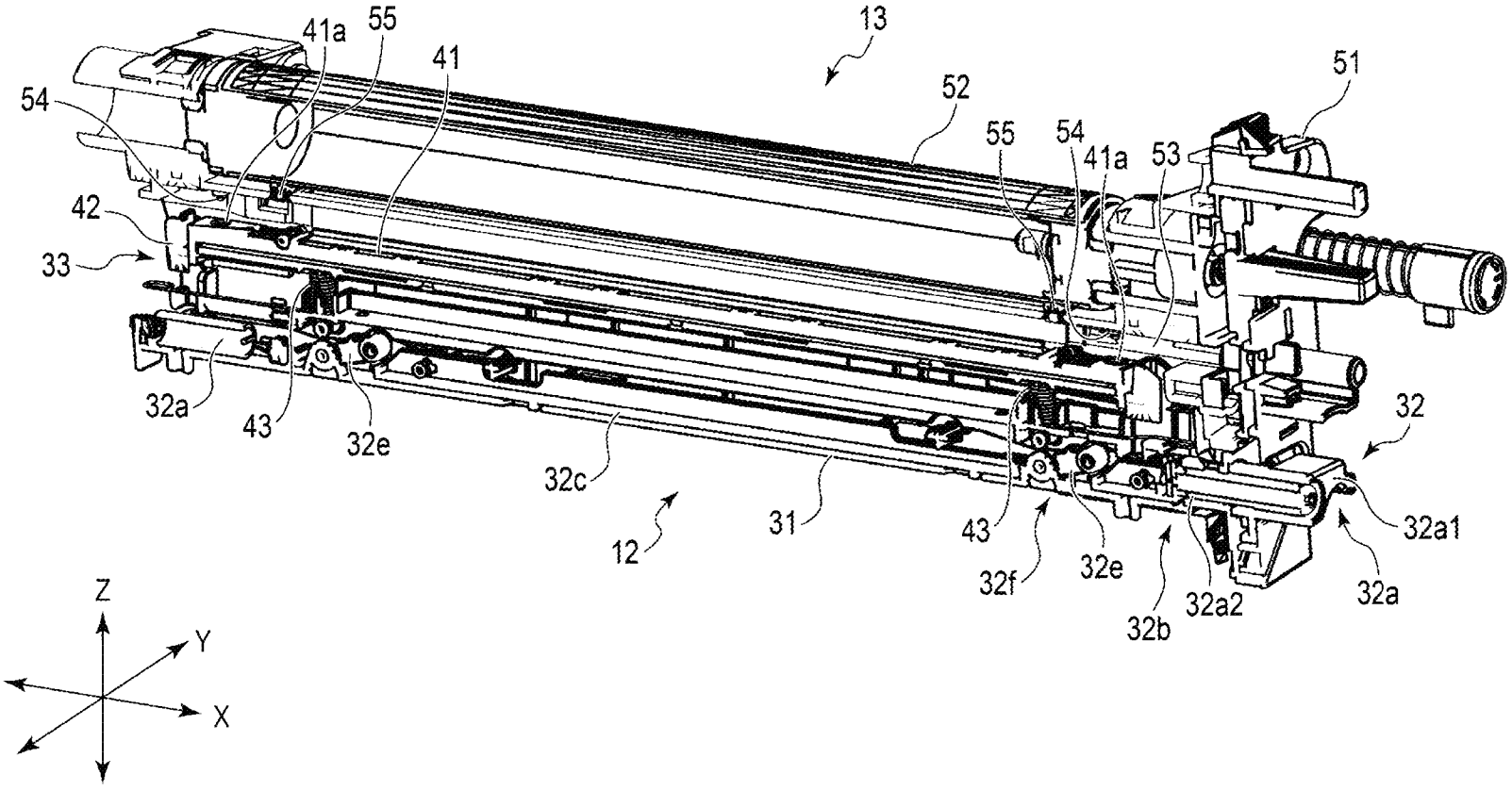
FIG. 12 is another perspective view illustrating the configuration of the solid head unit and the image forming unit.
Figure 13:
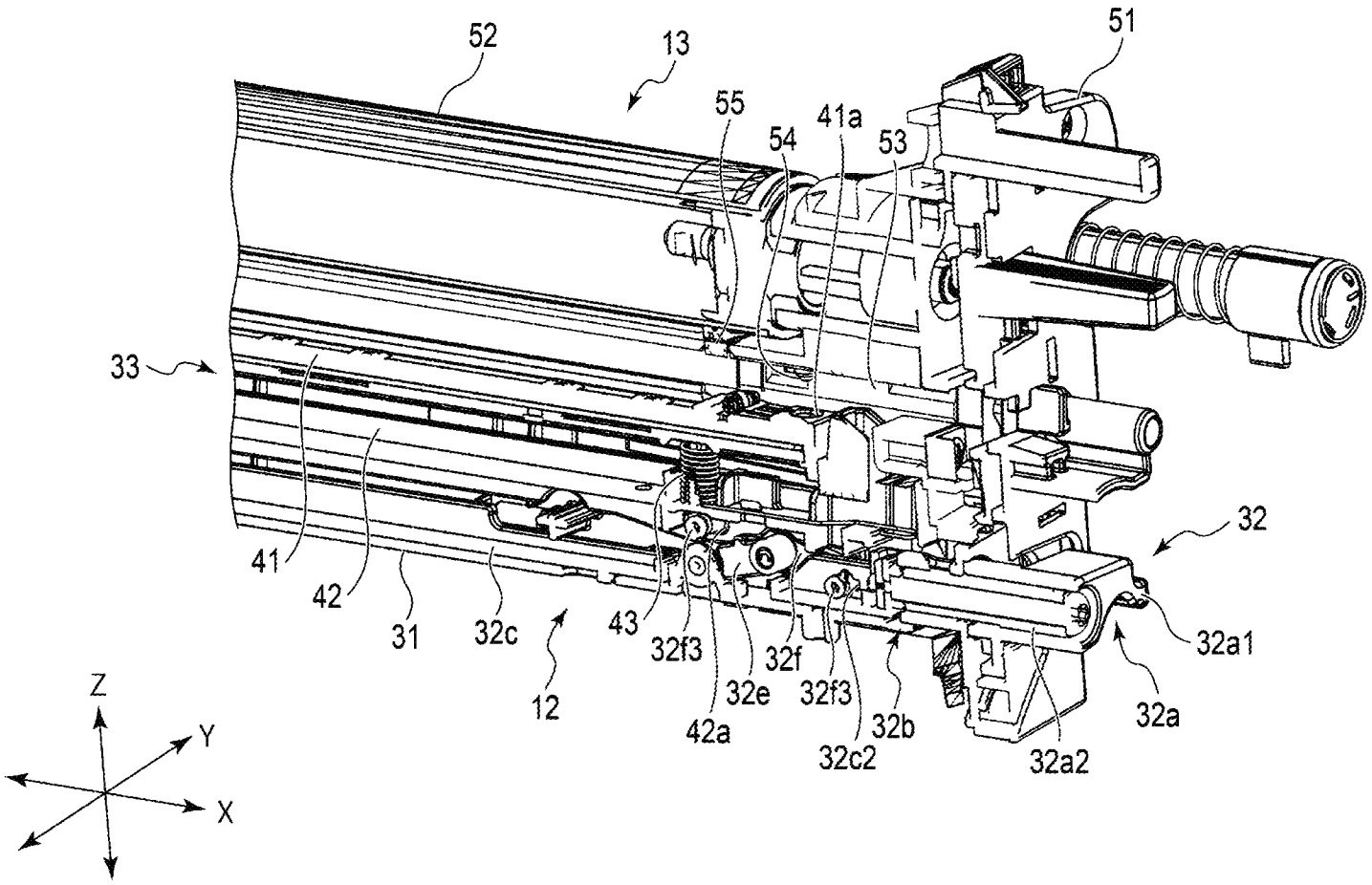
FIG. 13 is another perspective view illustrating the configuration of the solid head unit and the image forming unit.
Figure 14:
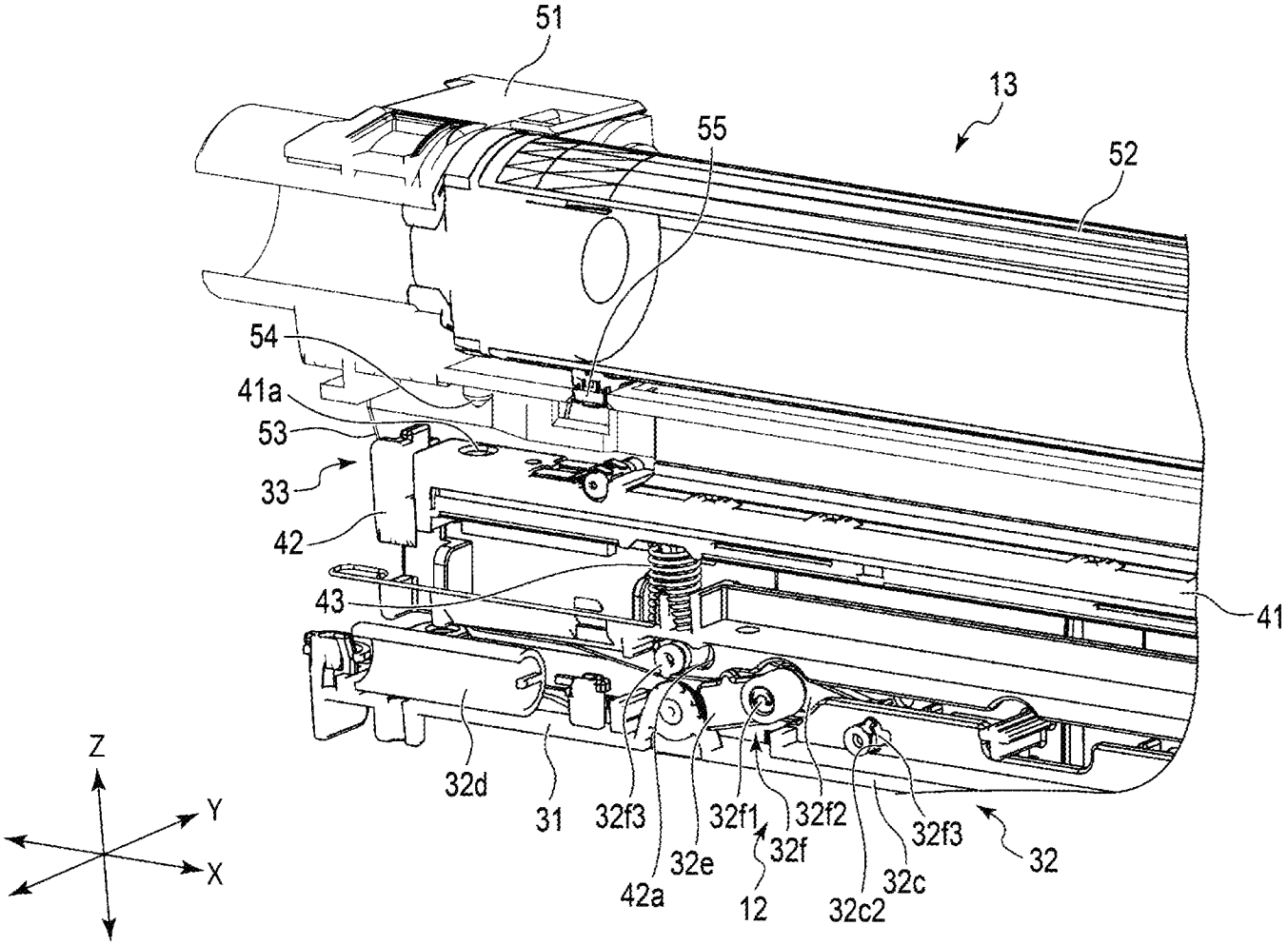
FIG. 14 is another perspective view illustrating the configuration of the solid head unit and the image forming unit.
Figure 15:
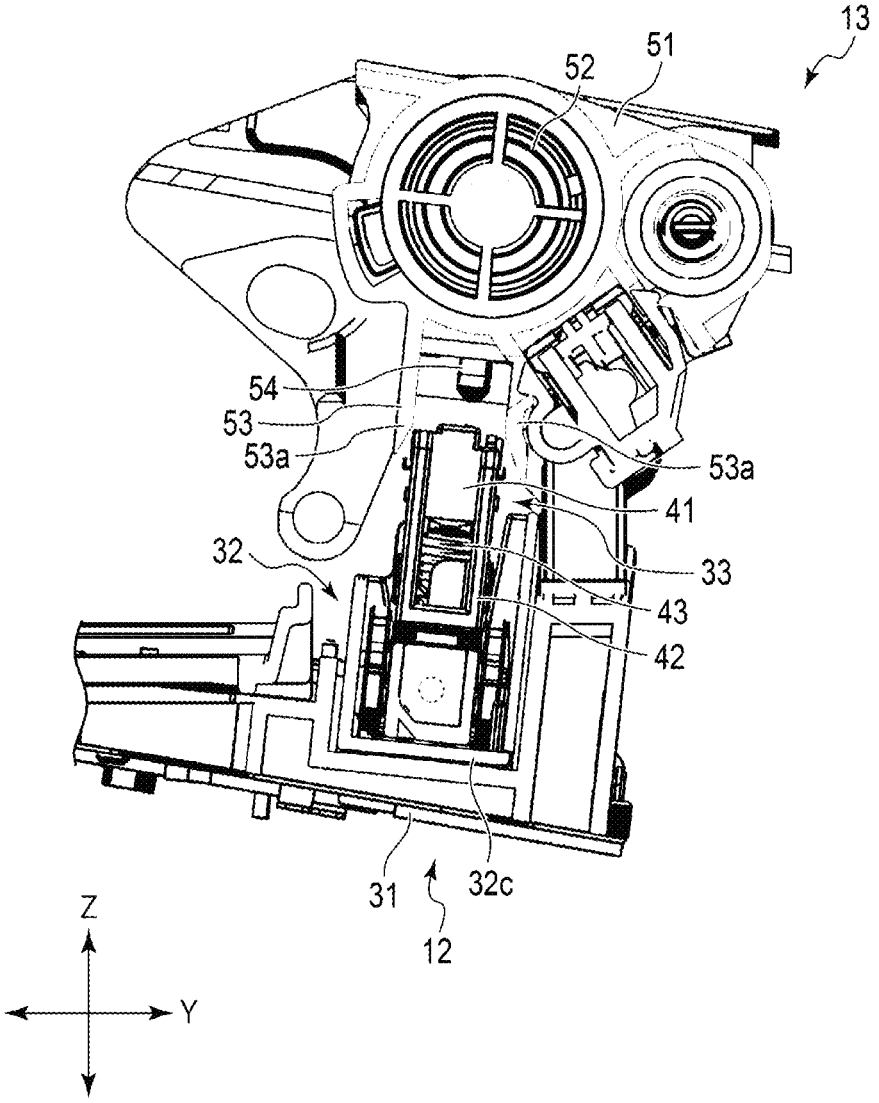
FIG. 15 is another cross-sectional view illustrating the configuration of the solid head unit and the image forming unit.

FIG. 8 is a perspective view illustrating the configuration of four solid head units 12 and four image forming units 13, and FIG. 9 is a perspective view illustrating the configuration of four solid head units 12 and one image forming unit 13. FIGS. 10 and 11 illustrate the configuration of one solid head unit 12 and one image forming unit 13 in a state where a solid head 33 is located at a predetermined position with respect to the image forming unit 13 in a perspective view and a cross-sectional view. FIGS. 12 to 15 are diagrams illustrating the configurations of one solid head unit 12 and one image forming unit 13 in a state where the solid head 33 is located at a position away from the image forming unit 13. FIG. 12 is a perspective view thereof, FIGS. 13 and 14 are perspective views illustrating configurations of both end sides of one solid head unit 12 and one image forming unit 13, respectively, and FIG. 15 is a cross-sectional view thereof.

Figure 16:
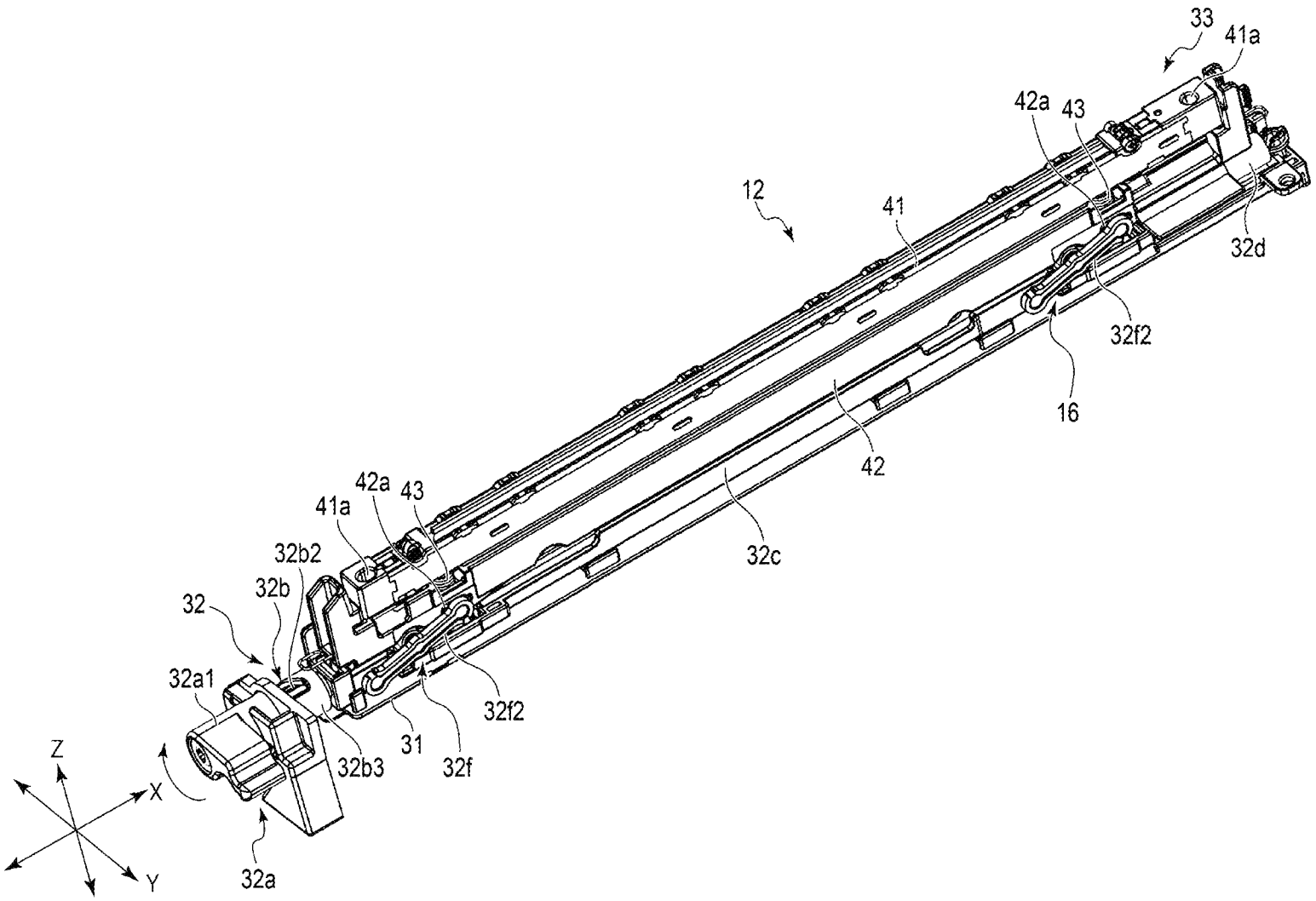
FIG. 16 is a perspective view illustrating a configuration of main portions of the solid head unit.
Figure 17:
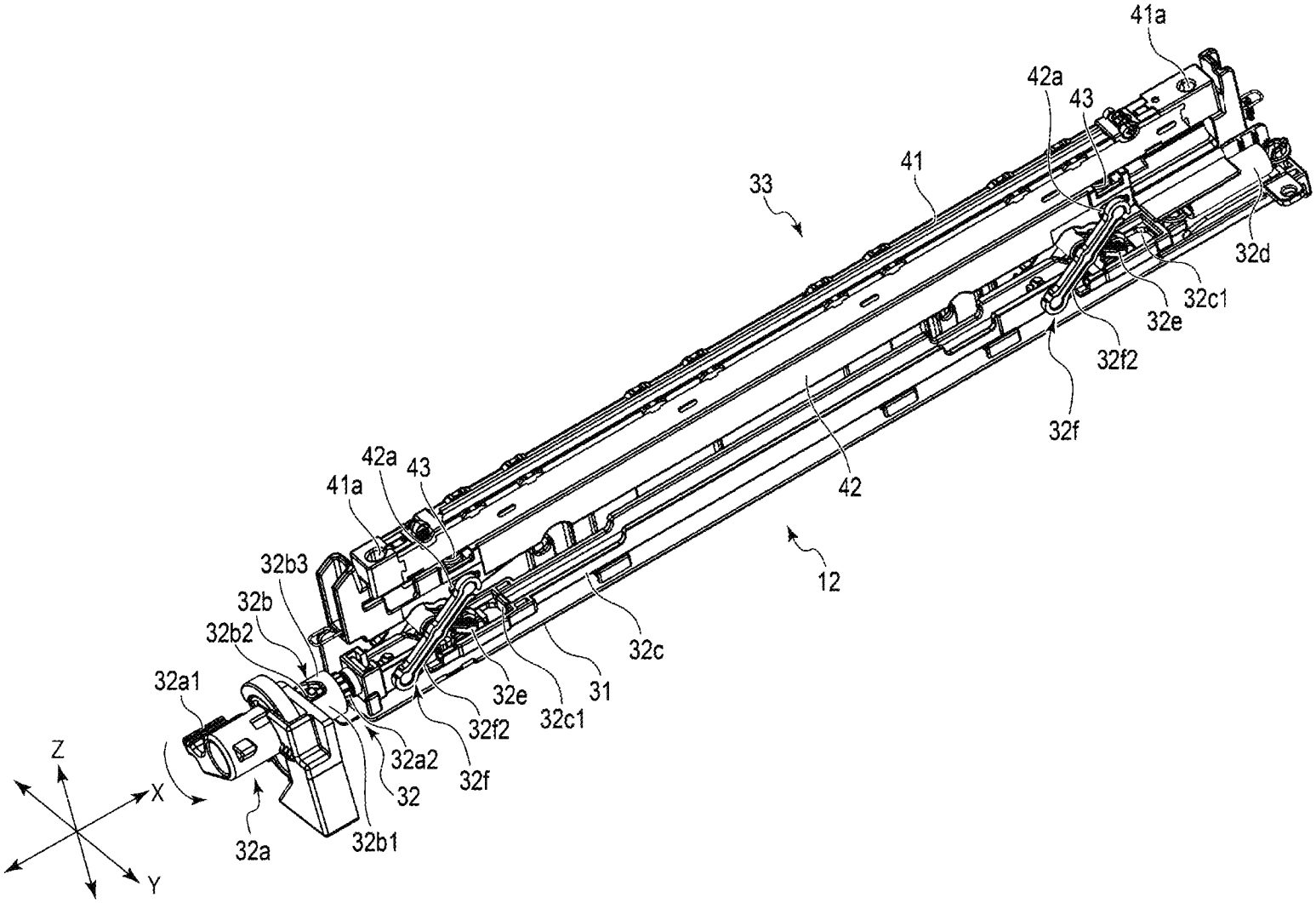
FIG. 17 is another perspective view illustrating the configuration of the main portions of the solid head unit.

FIGS. 16 and 17 are perspective views illustrating a configuration of a base 31, an elevating mechanism 32, and the solid head 33 of the solid head unit 12. FIG. 16 illustrates a state where the solid head 33 is lowered to the base 31 side and FIG. 17 illustrates a state where the solid head 33 is raised with respect to the base 31.

Figure 18:
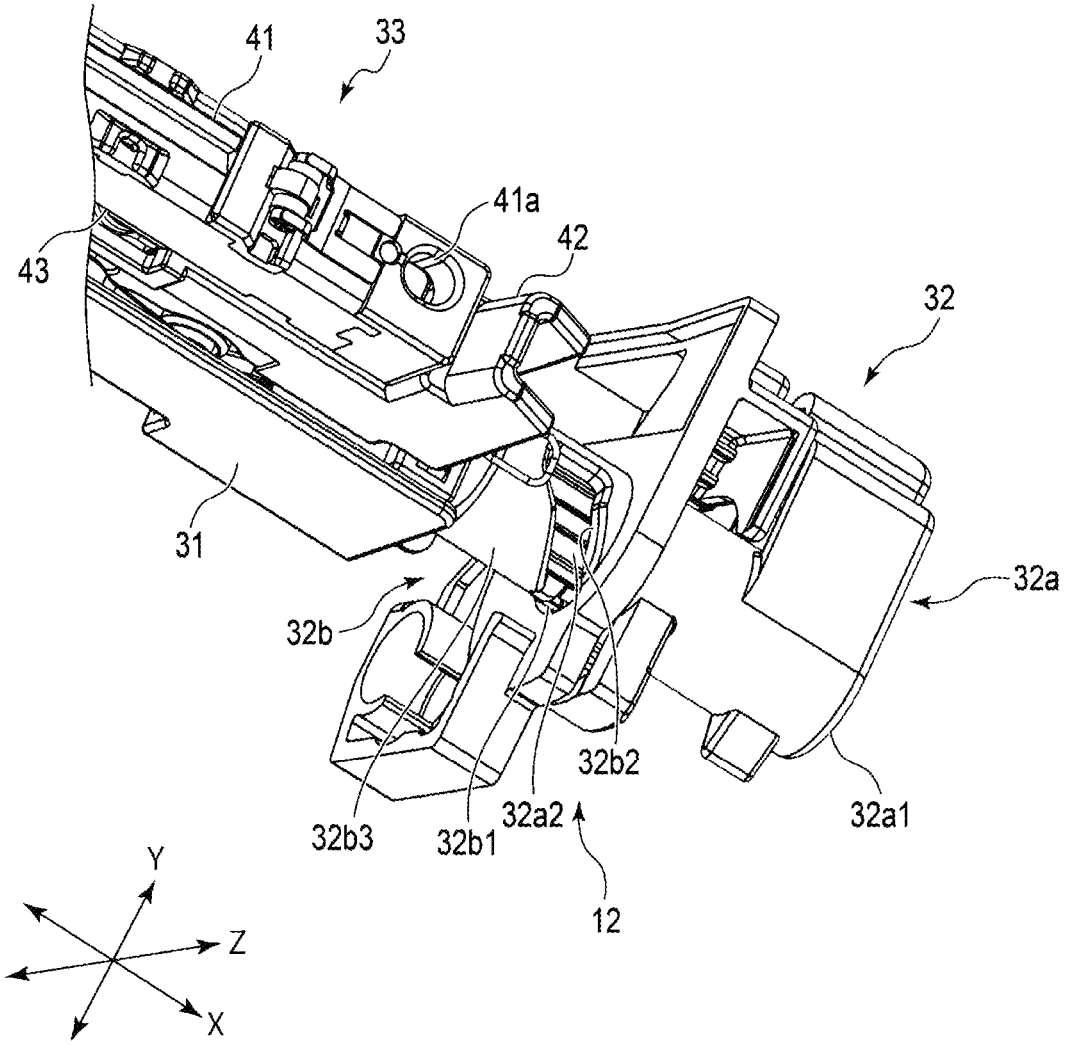
FIG. 18 is a perspective view illustrating the configuration of the main portions of the solid head unit in an enlarged manner.
Figure 19:
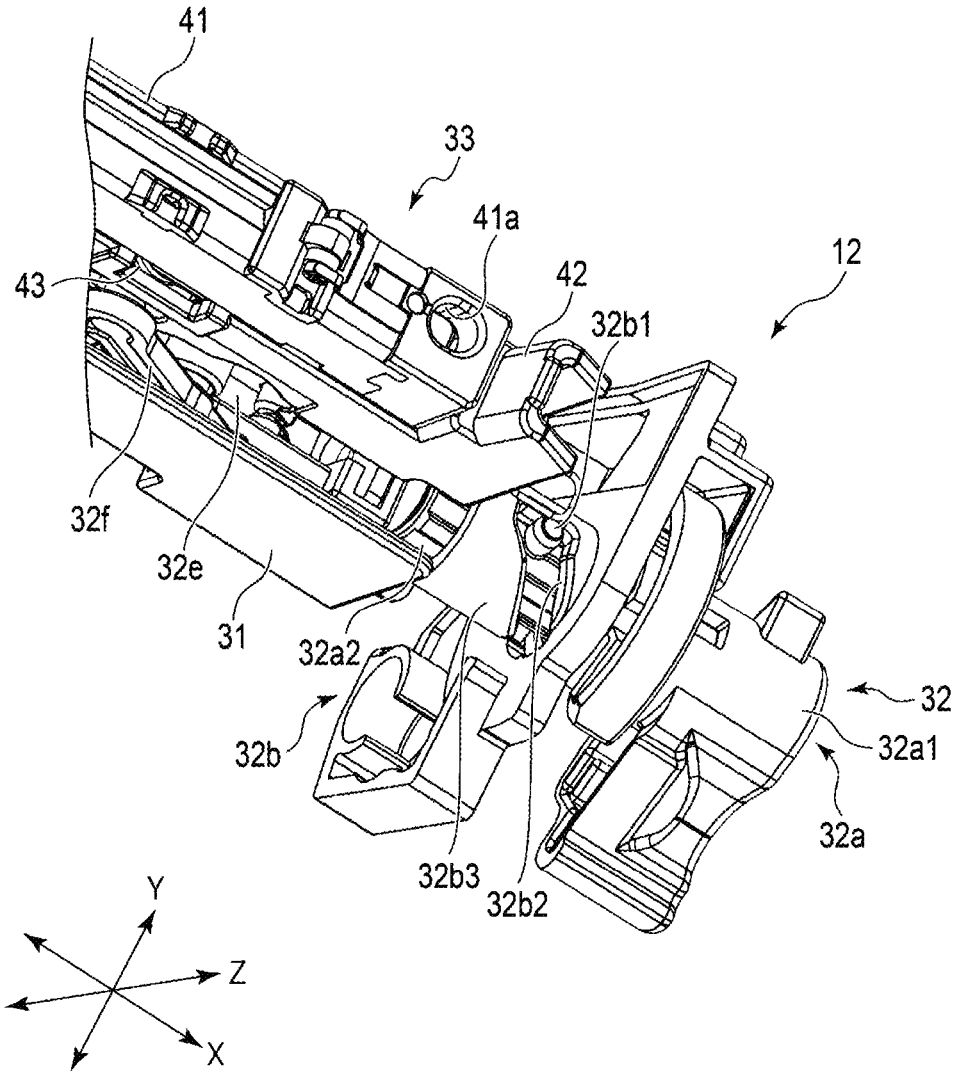
FIG. 19 is another perspective view illustrating the configuration of the main portions of the solid head unit in an enlarged manner.

FIGS. 18 and 19 are perspective views illustrating the configuration of the base 31, the elevating mechanism 32, and the solid head 33 on an operation lever 32*a* side of the elevating mechanism 32. FIG. 18 illustrates a state where the solid head 33 is lowered to the base 31 side, and FIG. 19 illustrates a state where the solid head 33 is raised with respect to the base 31.

Figure 20:
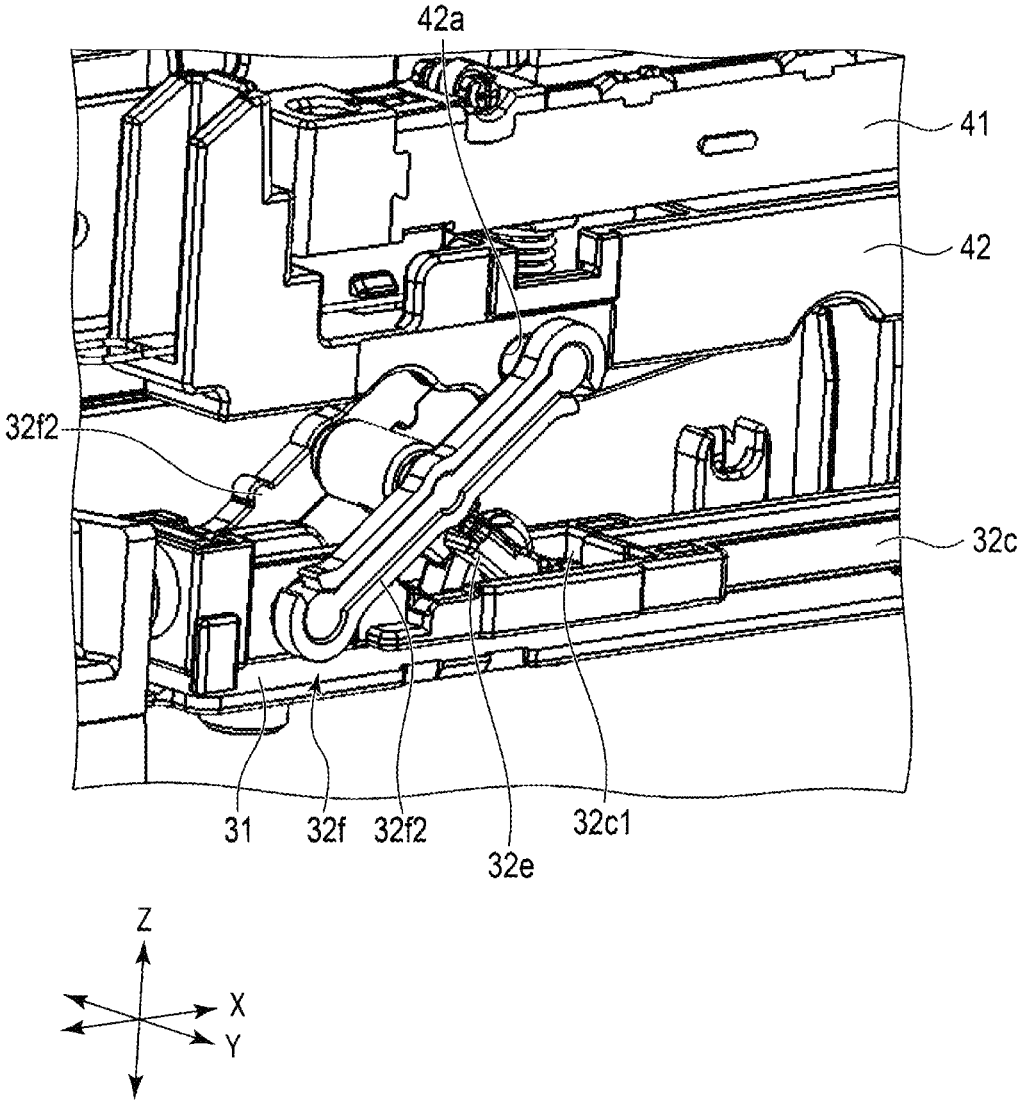
FIG. 20 is another perspective view illustrating the configuration of the main portions of the solid head unit in an enlarged manner.
Figure 21:
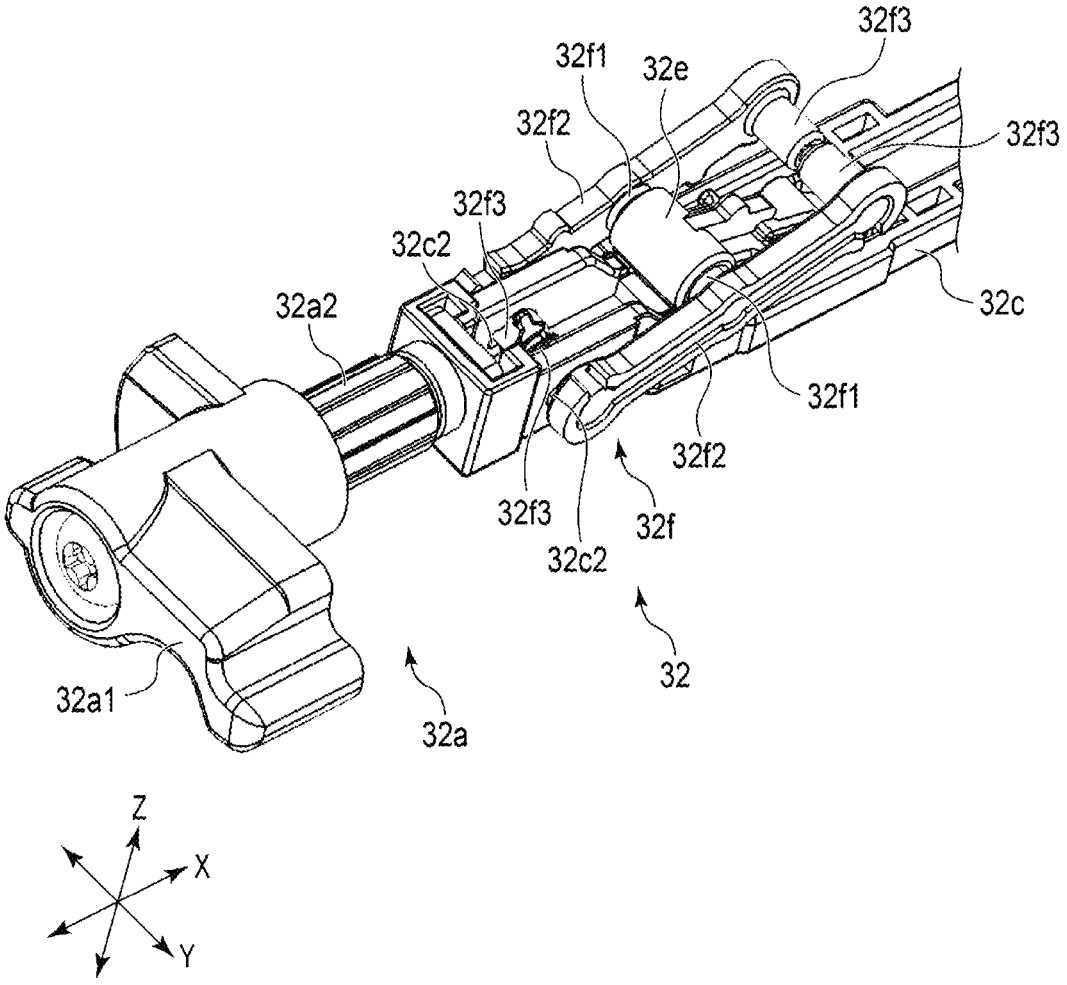
FIG. 21 is a perspective view illustrating a configuration of an elevating mechanism of the solid head unit in an enlarged manner.
Figure 22:
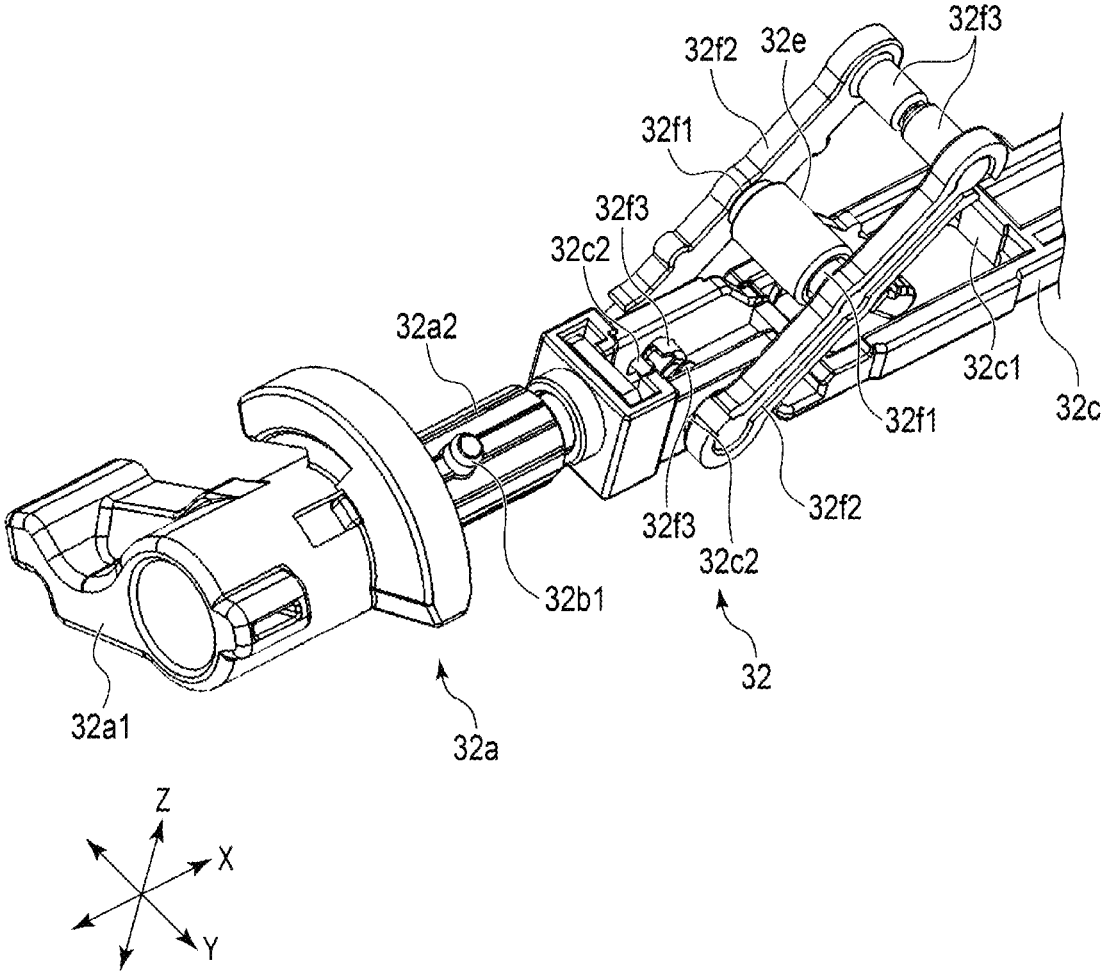
FIG. 22 is a perspective view illustrating the configuration of the elevating mechanism in an enlarged manner.

FIG. 20 is a perspective view illustrating the configuration of the base 31, the elevating mechanism 32, and the solid head 33 in an enlarged manner. FIGS. 21 and 22 are perspective views illustrating the configuration of an upper front side of the elevating mechanism 32 in an enlarged manner from the front side toward the rear side, which omit a cylindrical body 32*b*3 of a conversion mechanism 32*b*. FIG. 21 illustrates a state where the elevating mechanism 32 is lowered, and FIG. 22 illustrates a state where the elevating mechanism 32 is raised.

Figure 23:
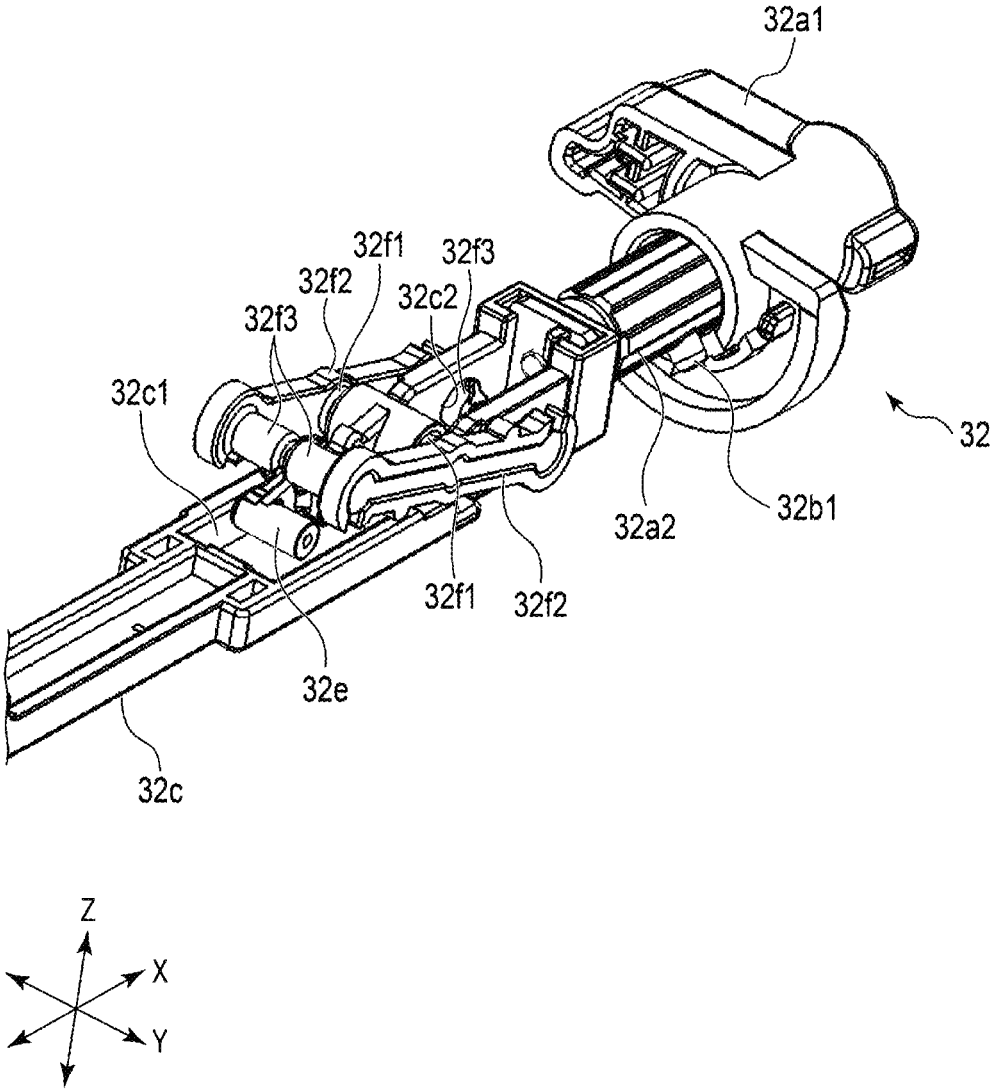
FIG. 23 is another perspective view illustrating the configuration of the elevating mechanism in an enlarged manner.
Figure 24:
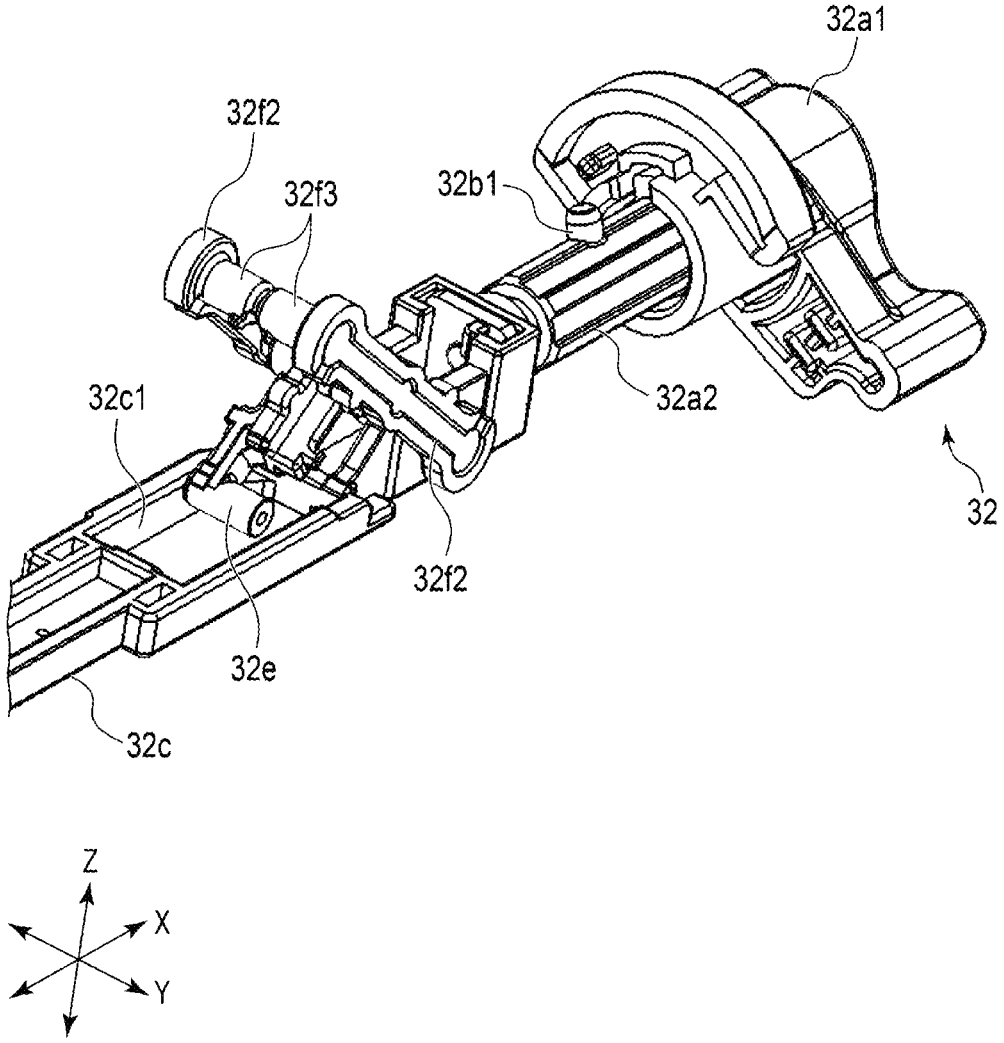
FIG. 24 is another perspective view illustrating the configuration of the elevating mechanism in an enlarged manner.

FIGS. 23 and 24 are perspective views illustrating the configuration of the upper front side of the elevating mechanism 32 in an enlarged manner from the rear side toward the front side, which omit the cylindrical body 32*b*3 of the conversion mechanism 32*b*. FIG. 23 illustrates a state where the elevating mechanism 32 is lowered, and FIG. 24 illustrates a state where the elevating mechanism 32 is raised.

Figure 25:
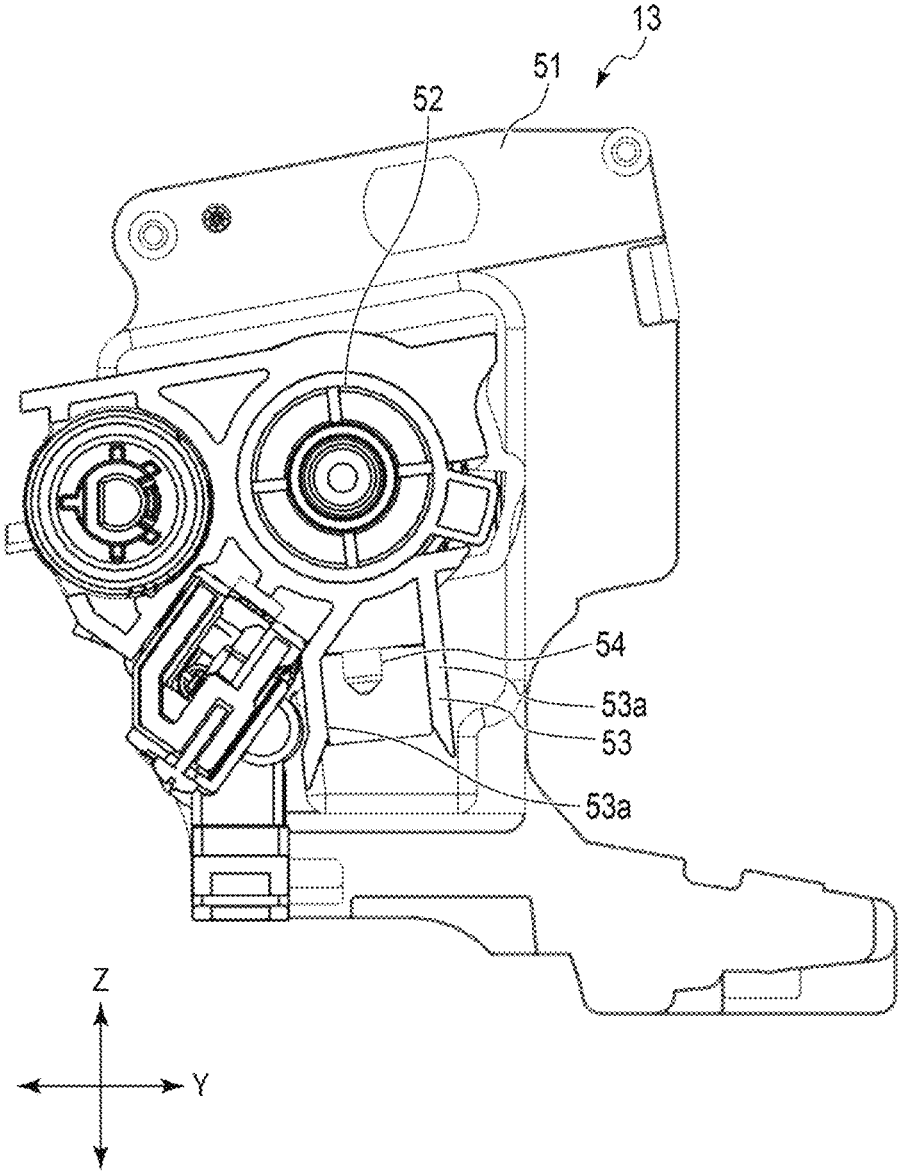
FIG. 25 is a cross-sectional view illustrating a configuration of a drum case used in the image forming unit.
Figure 26:
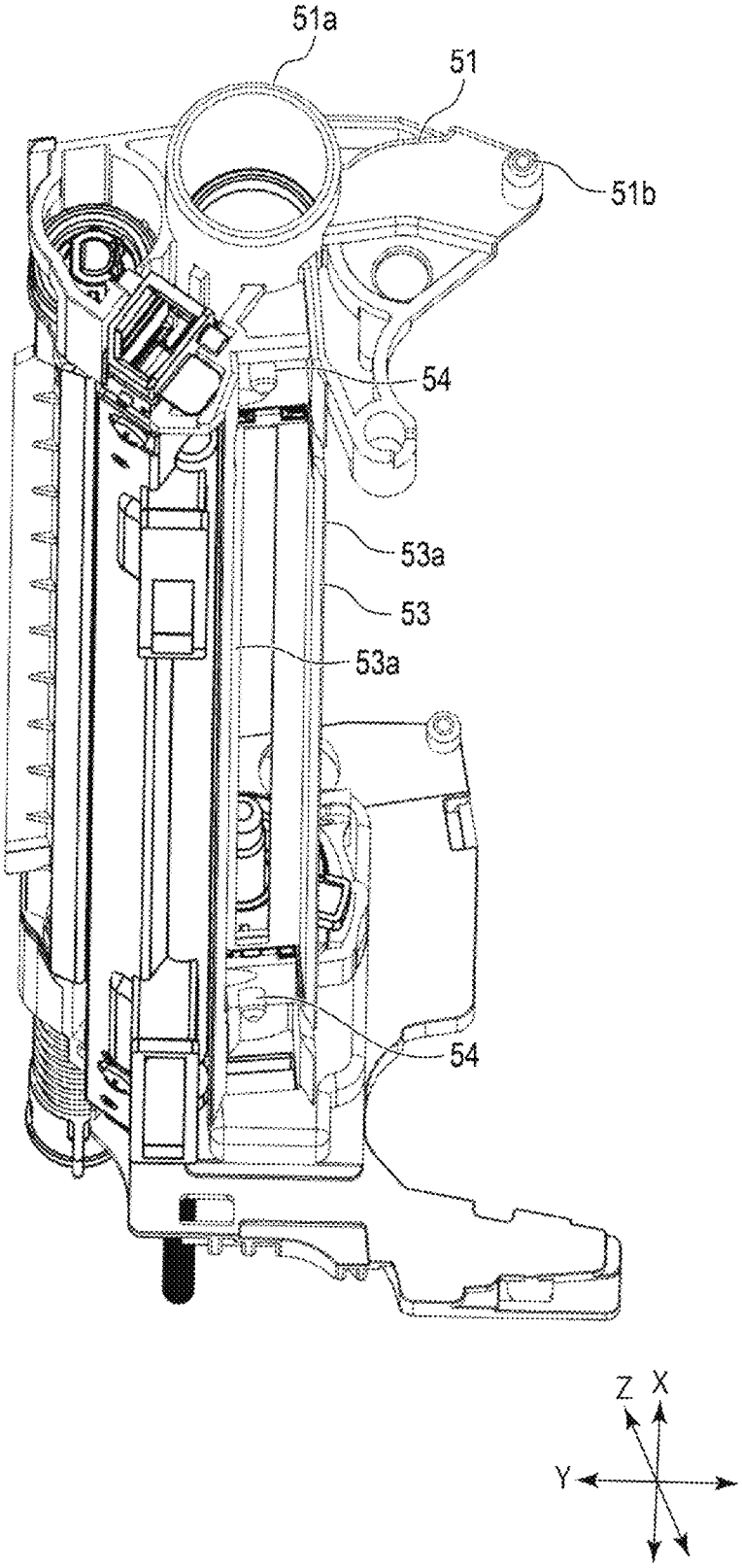
FIG. 26 is a perspective view illustrating the configuration of the drum case.

FIG. 25 is a cross-sectional view illustrating the configuration of the image forming unit 13 and FIG. 26 is a perspective view illustrating a configuration of a drum case 51 used in the image forming unit 13.

Figure 27:
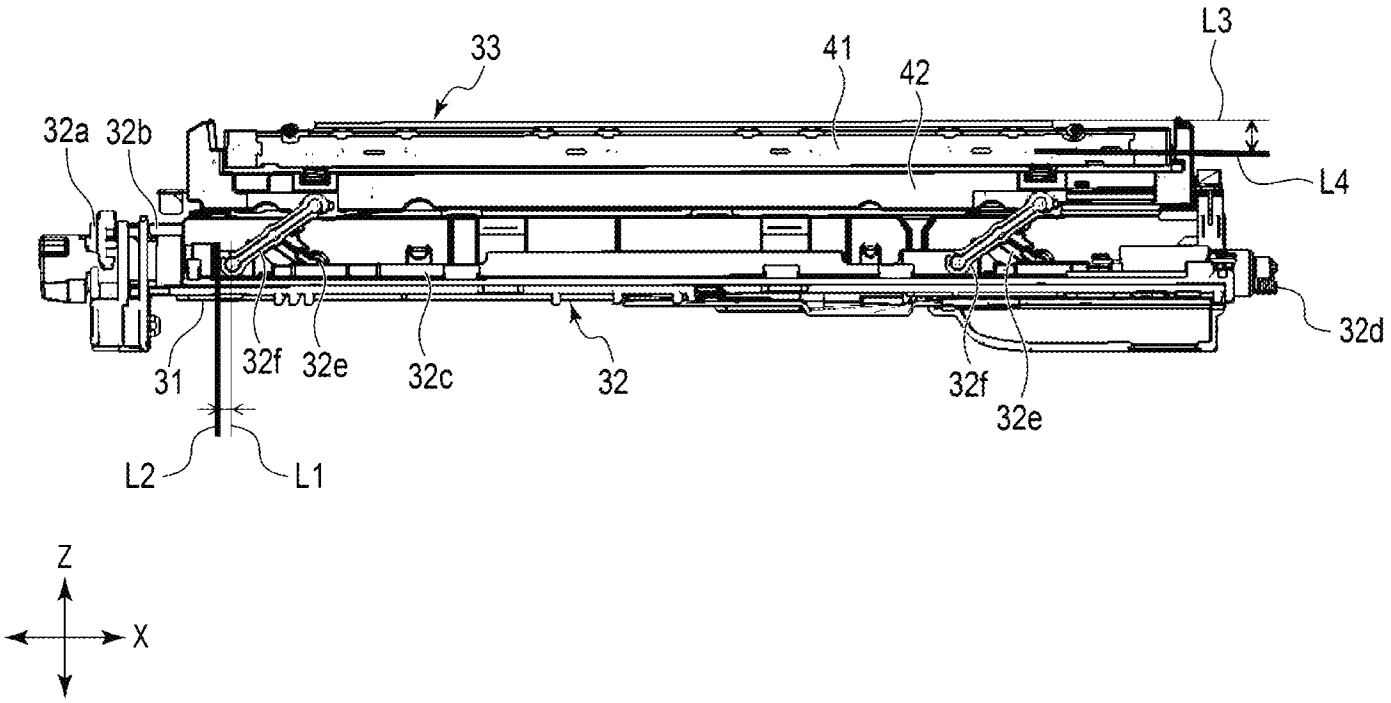
FIG. 27 is an explanatory view illustrating one operation of the solid head unit.
Figure 28:
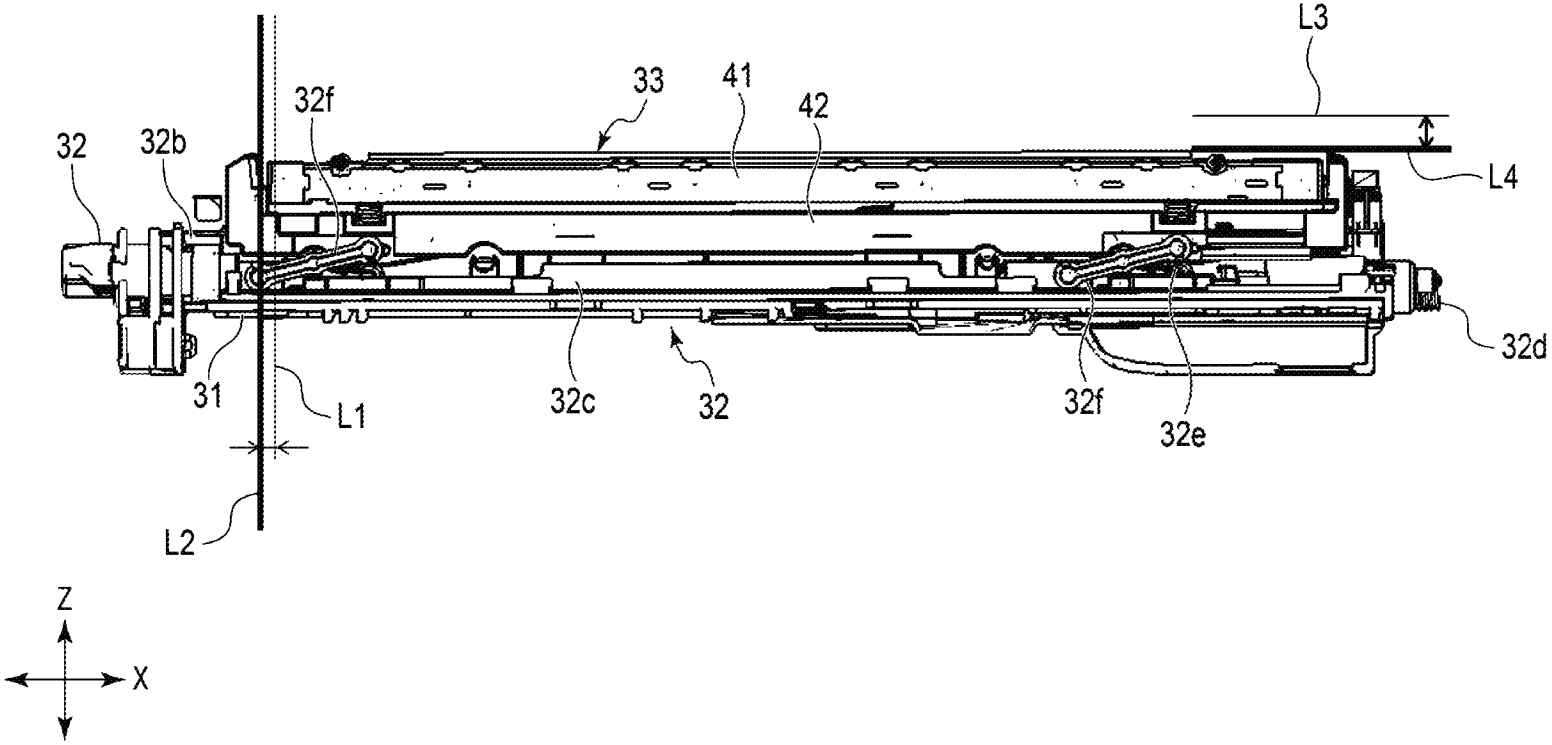
FIG. 28 is another explanatory view illustrating one operation of the solid head unit.

FIG. 27 illustrates a state where the solid head unit 12 is raised, and FIG. 28 illustrates a state where the solid head unit 12 is lowered.

The image forming apparatus 1 is, for example, a multi-function peripheral (MFP) that integrates functions such as copying, scanning, and printing. As illustrated in FIGS. 1 to 3, the image forming apparatus 1 includes the frame 11, a plurality of solid head units 12, and a plurality of image forming units 13. As illustrated in FIGS. 1 to 3, the image forming apparatus 1 includes, for example, a storage tray 14, a scanner unit 15, a transfer belt 16, a fixing device 17, a paper discharge tray 18, a conveyance device (a conveyor), and a control unit (a controller). The image forming apparatus 1 is provided with a decorative plate along at least one outer surface thereof.

The number of solid head units 12 and image forming units 13 used in the image forming apparatus 1 is set according to a type of developer used in the image forming apparatus 1. In the embodiment, as an example, a configuration in which toners of four colors including yellow, magenta, cyan, and black are used as the developer will be described. Therefore, as illustrated in FIGS. 1 to 3 and FIG. 8, at least one embodiment, for example, may include four solid head units 12 and four image forming units 13 in the image forming apparatus 1.

As illustrated in FIGS. 1 to 7, the frame 11 includes a front frame 21, a rear frame 22, and a plurality of connecting frames 23. A decorative plate is provided along the outer surfaces of the frame 11. The frame 11 supports various components used in the image forming apparatus 1.

As illustrated in FIGS. 6 and 7, the front frame 21 and the rear frame 22 are disposed to face each other in the X-direction, which is a direction in which the image forming unit 13 of the image forming apparatus 1 is inserted. The front frame 21 and the rear frame 22 are coupled together by, for example, the connecting frames 23 or the like. Four solid head units 12 are coupled to the front frame 21 and the rear frame 22.

As illustrated in FIGS. 4 to 7, the front frame 21 has an insertion port 21*a* into which the plurality of image forming units 13 are inserted from the front frame 21 side toward the rear frame 22 along the X-direction. The insertion port 21*a* is an opening formed in the front frame 21. The insertion port 21*a* exposes end portions of the solid head units 12 coupled to the frame 11 and the image forming units 13 to the outside of the frame 11. As a specific example, the insertion port 21*a* exposes at least an operation lever 32*a* (described later) of the solid head units 12 and the image forming units 13 to the outside. That is, the insertion port 21*a* has a shape in which the four image forming units 13 can be inserted in a state where the end portions of the four solid head units 12 are exposed to the outside. The shape of the insertion port 21*a* is appropriately set according to the number and disposition of the solid head units 12 and the image forming units 13. In the embodiment, as illustrated in FIG. 2, the image forming units 13 are disposed above the solid head units 12 in the Z-direction, and height positions of the four solid head units 12 and the four image forming units 13 in the Z-direction gradually change from a first side to an opposing second side thereof in the Y-direction. The shape of the insertion port 21*a* is, therefore, a shape in which the solid head units 12 and the image forming units 13 can be disposed.

The rear frame 22 has a plurality of support holes 22*a* and a plurality of guide holes 22*b*. The support holes 22*a* and the guide holes 22*b* are provided in the same number as the number of the image forming units 13 such that, in the embodiment shown, four support holes 22*a* and four guide holes 22*b* are provided. Each support hole 22*a* and each guide hole 22*b* are formed in a region that faces the insertion port 21*a* formed in the front frame 21 in the X-direction, of the rear frame 22. The support hole 22*a* supports the tip side of the image forming unit 13 in the insertion direction thereof. The support hole 22*a* is a circular hole formed in the rear frame 22. The guide hole 22*b* guides a posture of the image forming unit 13 relative to an axis along the insertion direction of the image forming unit 13, which is supported by the support hole 22*a* that functions as the center of rotation. The guide hole 22*b* is a circular hole formed in the rear frame 22. The inner diameter of the guide hole 22*b* is set to be smaller than the inner diameter of the support hole 22*a*.

As illustrated in FIGS. 8 to 24, the solid head unit 12 includes the base 31, the elevating mechanism 32, the solid head 33, and a first guide 34. The solid head unit 12, in at least one embodiment, is formed to have one side that is longer in one direction (a longitudinal direction) than another side, and is fixed coupled to the frame 11 so that the longitudinal direction of the solid head unit 12 is along the X-direction.

The base 31 is coupled to the front frame 21 and the rear frame 22 by a fastening member such as a screw. The base 31 supports a part of the elevating mechanism 32.

The elevating mechanism 32 reciprocates the solid head 33 in one direction with respect to the base 31. Hereinafter, the reciprocation of the solid head 33 in one direction with respect to the base 31 will be described as raising and lowering. As illustrated in FIGS. 9 to 19, each elevating mechanism 32 includes, for example, the operation lever 32*a*, the conversion mechanism 32*b*, a slider 32*c*, an urging or biasing member 32*d*, a support member 32*e*, and a link 32*f*.

The operation lever 32*a* is rotatable within a predetermined angular range. As illustrated in FIGS. 10, 12, 13, 16 to 19, and 21 to 24, the operation lever 32*a* includes an operation portion 32*a*1 that is selectively rotatable by an operator and a shaft portion 32*a*2 that is integral with the operation portion 32*a*1. The shaft portion 32*a*2 rotates with the operation portion 32*a*1.

The conversion mechanism 32*b* converts rotational movement of the shaft portion 32*a*2 into movement in the axial direction of the shaft portion 32*a*2. In the posture in which the solid head unit 12 is coupled to the frame 11, the axial direction of the shaft portion 32*a*2 is along the X-direction.

As a specific example, as illustrated in FIGS. 16 to 19 and 21 to 24, the conversion mechanism 32*b* includes a protrusion 32*b*1 coupled to a part of the outer peripheral surface of the shaft portion 32*a*2 and the cylindrical body 32*b*3 covers the shaft portion 32*a*2 and defines a groove 32*b*2 extending in a direction inclined with respect to the peripheral direction and the axial direction. As a specific example, the groove 32*b*2 is an opening extending spirally along the peripheral surface of the cylindrical body 32*b*3. When the operation portion 32*a*1 is operated and the shaft portion 32*a*2 rotates, the movement of the protrusion 32*b*1 provided on the shaft portion 32*a*2 is guided by the groove 32*b*2, and thus the conversion mechanism 32*b* converts the movement in the rotation direction of the shaft portion 32*a*2 into the movement in the axial direction in addition to the movement in the rotation direction of the shaft portion 32*a*2. The cylindrical body 32*b*3 is fixed to the base 31, for example.

The slider 32*c* is coupled to the shaft portion 32*a*2 in the axial direction of the shaft portion 32*a*2. For example, the slider 32*c* is coupled to the shaft portion 32*a*2 by a fastening member such as a screw. As a specific example, the slider 32*c* is coupled to the shaft portion 32*a*2 so that the shaft portion 32*a*2 can rotate around the axis along the X-direction with respect to the slider 32*c*. The slider 32*c* is supported by the base 31 so as to be movable in the X-direction. That is, the slider 32*c* moves linearly. The shaft portion 32*a*2 is coupled to one end side of the slider 32*c* in the X-direction, and the urging member 32*d* is coupled to the other end side thereof. The slider 32*c* operates the link 32*f* in the X-direction when moving along the X-direction. As a specific example, the slider 32*c* rotatably supports one end of the link 32*f*. The slider 32*c* has openings 32*c*1 in which the support member 32*e* is disposed. Each opening 32*c*1 exposes a part of the upper surface of the base 31. The openings 32*c*1 are provided at both ends of the slider 32*c*.

The urging member 32*d* urges or biases the slider 32*c* in one direction. As a specific example, the urging member 32*d* is a coil spring. The urging member 32*d* urges the slider 32*c* in a direction away from the operation lever 32*a* along the X-direction. One end of the urging member 32*d* is supported by the base 31, and the other end thereof is supported by the slider 32*c*.

One end of the support member 32*e* is rotatably supported by the base 31, and the other end thereof rotatably supports a first shaft 32*f*1 (described later) of the link 32*f*. For example, two support members 32*e* are provided. For example, one of the two support members 32*e* is provided on the upper surface on one end side of the base 31 in the X-direction, and is disposed in one opening 32*c*1 of the slider 32*c*. The other of the two support members 32*e* is provided on the upper surface on the other end side of the base 31 in the X-direction, and is disposed in the other opening 32*c*1 of the slider 32*c*.

The links 32*f* are provided, for example, at two locations in the X-direction. The link 32*f* is rotatably connected to the support member 32*e*, the slider 32*c*, and the solid head 33. The link 32*f* converts the movement of the slider 32*c* into the raising and lowering of the solid head 33. As illustrated in FIGS. 10, 12 to 14, 16, 17, and 20 to 24, the link 32*f* includes a first shaft 32*f*1 rotatably supported by the support member 32*e*, a link body 32*f*2 provided at an end portion in the axial direction of the first shaft 32*f*1, and two second shafts 32*f*3 provided at both ends of the link body 32*f*2. As illustrated in FIGS. 20 to 24, as a specific example, one link 32*f* includes a pair of the first shafts 32*f*1, a pair of the link bodies 32*f*2, and a pair of the two second shafts 32*f*3.

The link body **32*f*2 is a plate-like or bar-like member that is long in one direction. The link body 32*f*2 is provided with the first shaft 32*f*1 proximate the center in the longitudinal direction and the second shafts 32*f*3 are respectively provided at both ends in the longitudinal direction. Each second shaft 32*f*3 protrudes from the main surfaces at both ends of the link body 32*f*2 in the same direction as the first shaft 32*f*1. For example, the pair of link bodies 32*f*2 is disposed in a posture in which the first shafts 32*f*1 and the second shafts 32*f*3 provided on the pair of link bodies 32*f*2** face each other.

As illustrated in FIGS. 13, 14, and 21 to 23, for example, a pair of first shafts **32*f*1 disposed to face the pair of link bodies 32*f*2 is rotatably connected to the support member 32*e*. As a specific example, the pair of first shafts 32*f*1 is inserted into holes provided in the support member 32*e***.

As illustrated in FIGS. 21 to 24, for example, the second shafts **32*f*3 provided on one end side of the link body 32*f*2 are rotatably connected to the slider 32*c*. For example, the second shafts 32*f*3 provided on the other end side of the link body 32*f*2 are rotatably connected to the solid head 33. For example, as illustrated in FIGS. 13 and 14, the pair of second shafts 32*f*3 is rotatably supported by holes 32*c*2 provided on the side surfaces of the slider 32*c* and holes 42*a* provided on the side surface of the solid head 33**, respectively.

As a specific example, the slider **32*c* has a pair of the holes 32*c*2 provided in both side surfaces on each of both end sides in the X-direction of the slider 32*c*. The pair of the second shafts 32*f*3 disposed to face the pair of link bodies 32*f*2 is inserted into the pair of holes 32*c*2 of the slider 32*c*. As a specific example, the solid head 33 has a pair of the holes 42*a* provided in both side surfaces on each of both end sides in the X-direction of the solid head 33. The other pair of second shafts 32*f*3 disposed to face the pair of link bodies 32*f*2 is inserted into the pair of holes 42*a* of the solid head 33**.

Such a link **32*f* is connected to the support member 32*e*, the slider 32*c*, and the solid head 33 in a double-supported structure by the pair of first shafts 32*f*1, the pair of link bodies 32*f*2, and the pair of two second shafts 32*f*3. In the link 32*f*, when the slider 32*c* moves in the X-direction, one second shaft 32*f*3 supported by the slider 32*c* moves in the X-direction, and thus a force in the X-direction is applied to the end portion of the link body 32*f*2 on the slider 32*c* side. However, the slider 32*c* moves only in the X-direction, and the other second shaft 32*f*3 of the link body 32*f*2 is supported by the solid head 33. Therefore, the first shaft 32*f*1 provided at the center of the link body 32*f*2 in the longitudinal direction presses the support member 32*e*, and rotates the support member 32*e* with respect to the base 31 around one end of the support member 32*e*. In this case, the link body 32*f*2 rotates around the first shaft 32*f*1, and thus an angle of the link body 32*f*2 with respect to the X-direction changes and the second shaft 32*f*3 supported by the solid head 33 rises and falls. As such, in the link 32*f*, when the slider 32*c* moves in the X-direction, the link body 32*f*2 and the support member 32*e* rotationally move, and thus the second shaft 32*f*3 on the solid head 33 side rises and falls to raise and lower the solid head 33 with respect to the base 31**.

The solid head 33 is an exposure device. The solid head 33 includes a light source for writing that forms an electrostatic latent image on the image forming unit 13. As illustrated in FIGS. 10 to 19, the solid head 33 includes a print head 41, a holding tray or holder 42, and a biasing member or an urging member 43. When the solid head 33 is raised with respect to the base 31 and is located at a predetermined position with respect to the image forming unit 13, for example, a part of the tip of the print head 41 or the holder 42 in a rising direction engages or abuts on a part of the image forming unit 13.

The print head 41 has a shape that is long in one direction. The print head 41 is, for example, a light emitting diode (LED) print head that uses LEDs, which emit light, as a light source. The print head 41 is disposed in a predetermined positional relationship in the axial direction of the photosensitive drum 52 and a radial direction of the photosensitive drum 52, with respect to the photosensitive drum 52 (described later) of the image forming unit 13 when exposing the image forming unit 13. As illustrated in FIGS. 12 to 14 and 16 to 19, the print head 41 has guide openings **41*a* formed at both end portions in the longitudinal direction and at the tip in the rising direction of the solid head 33. The print head 41 includes, for example, an abutting surface in which end surfaces of both end portions thereof where the openings 41*a* are formed abut on a part of the image forming unit 13. Each opening 41*a* is a circular or oval hole. For example, a ridge portion of the opening 41*a* with the tip surface and the inner peripheral surface of the print head 41 may be formed in a chamfered shape by an annular flat surface or a curved surface. The print head 41 appropriately includes a protrusion or an abutting portion that abuts the configuration of any of the image forming units 13 so as to be located at a predetermined position with respect to the photosensitive drum 52 of the image forming unit 13**.

The holder 42 supports the print head 41. As illustrated in FIGS. 10, 12, 16, and 17, as a specific example, the holder 42 supports the lower surface side of the print head 41 opposite to the side facing the photosensitive drum 52 and both ends of the print head 41 in the longitudinal direction corresponding to an elevating direction of the solid head 33. The holder 42 is connected to, for example, the two links **32*f*. As a specific example, as illustrated in FIGS. 13, 14, 16, and 17, the holder 42 has holes 42*a* on both end sides in the X-direction and on both side surfaces in the Y-direction. That is, holes 42*a* into which the second shafts 32*f*3 are inserted are formed at four locations on both side surfaces on both end sides of the holder 42. One second shaft 32*f*3 provided at the end portion of the link body 32*f*2 is rotatably disposed in each hole 42*a***.

The urging member 43 urges the print head 41 in a direction away from the holder 42 toward the photosensitive drum 52. A plurality of the urging members 43 are provided. As illustrated in FIGS. 10, 12, 16, and 17, the urging member 43 is provided between the print head 41 and the holder 42 in the elevating direction of the print head 41 and at two locations on both end sides of the print head 41 in the longitudinal direction. The urging member 43 is, for example, a coil spring.

The first guide 34 is fixed to at least one of the frame 11 and the base 31. As illustrated in FIG. 5, when the image forming unit 13 is inserted from the insertion port **21*a* of the front frame 21 and when the image forming unit 13 moves on the solid head unit 12 in the X-direction after the image forming unit 13 is inserted from the insertion port 21*a*, the first guide 34 guides the movement direction of the image forming unit 13 along the X-direction. The first guide 34 is, for example, a rail that guides the image forming unit 13 by engaging a part of the image forming unit 13 when the image forming unit 13 is inserted from the insertion port 21*a*. As illustrated in FIG. 9, for example, the first guide 34 includes a pair of rails 34*a* extending in the X-direction and slidably supporting a part of the outer surface of the image forming unit 13**.

The image forming unit 13 is, for example, an electrophotographic process unit (EPU). In the embodiment, for example, as illustrated in FIG. 2, an image forming unit 13A containing a yellow toner, an image forming unit 13B containing a magenta toner, an image forming unit 13C containing a cyan toner, and an image forming unit 13D containing a black toner are disposed in this order from the primary side toward the secondary side in the paper sheet conveyance direction.

As illustrated in FIGS. 10 to 15, 25, and 26, the image forming unit 13 includes the drum case 51, the photosensitive drum 52, a second guide 53, and a protrusion or protruding body 54. As illustrated in FIGS. 12 to 14, the image forming unit 13 includes, for example, a plurality of spacers 55. The image forming unit 13 includes, for example, a developing roller, a charging unit, a toner tank, and a cleaner case.

As illustrated in FIG. 26, the drum case 51 is elongated in one direction. The drum case 51 rotatably supports the photosensitive drum 52. As illustrated in FIGS. 7 and 26, the drum case 51 includes a supported portion 51*a* inserted into the support hole 22*a* of the rear frame 22 and a guiding portion 51*b* inserted into the guide hole 22*b* of the rear frame 22 on one end side in the longitudinal direction. When the image forming unit 13 is inserted from the insertion port 21*a*, the drum case 51 abuts on the pair of rails 34*a* of the first guide 34 and guides the movement of the image forming unit 13 in the X-direction.

The supported portion 51*a* is formed, for example, in a cylindrical shape. The outer diameter of the supported portion 51*a* is set to be slightly smaller than the inner diameter of the support hole 22*a*.

The guiding portion 51*b* is formed, for example, in a columnar shape. The outer diameter of the guiding portion 51*b* is set to be slightly smaller than the inner diameter of the guide hole 22*b*, for example. The guiding portion 51*b* is inserted into the guide hole 22*b*, thereby guiding a posture of the drum case 51 in the rotation direction with the central axis of the supported portion 51*a* of the drum case 51 as the center of rotation.

The photosensitive drum 52 is formed so that charges can be uniformly formed on a surface thereof and an electrostatic latent image can be formed on the surface when the surface is exposed. The photosensitive drum 52 is formed so that the toner adhered to the electrostatic latent image can be transferred to paper.

The second guide 53 is formed integrally with or defined by the drum case 51. For example, the second guide 53 is molded integrally with the drum case 51 or assembled integrally with the drum case 51.

When the image forming unit 13 is inserted into the insertion port 21*a*, if the second guide 53 abuts on the solid head 33, the second guide 53 guides the position for the image forming unit 13 of the solid head 33 in the direction orthogonal to the insertion direction of the image forming unit 13 and the rising direction of the solid head 33. When the solid head 33 of the solid head unit 12 rises toward the photosensitive drum 52, the second guide 53 guides the movement of the solid head 33 so that the solid head 33 is located at a predetermined position with respect to the photosensitive drum 52.

For example, the second guide 53 at least abuts on the holder 42 of the solid head 33 to guide the solid head 33 to rise. As a specific example, the second guide 53 includes a pair of plate-like portions 53*a*, which may be flat, planar portions, extending in a direction along the axial direction of the photosensitive drum 52. The width on the photosensitive drum 52 side of the pair of plate-like portions 53*a* (second portion) is set to a uniform width that is the same as the width in the direction orthogonal to the longitudinal direction and the rising direction of the solid head 33 or slightly larger than the width in the direction orthogonal to the extent that the solid head 33 can be guided to a predetermined position of the photosensitive drum 52. The width of the tip portions (first portion) of the pair of plate-like portions 53*a* gradually decreases from the tips toward the photosensitive drum 52 side. As a specific example, the tip portions of the pair of plate-like portions 53*a* are formed by a flat surface inclined with respect to the rising direction of the solid head 33 or a curved surface with a tangent inclined with respect to the rising direction so that the width thereof gradually decreases from the tips toward the photosensitive drum 52 side (e.g., so as to be a non-uniform or tapered width, etc.). The width may decrease from a first width at the tip to a second, smaller width at a midpoint toward the drum 52 side, for example. Here, the width of the pair of plate-like portions 53*a* is a width of a gap formed between the facing surfaces of the pair of plate-like portions 53*a*. That is, as illustrated in FIG. 25, the width of the pair of plate-like portions 53*a* is a gap larger than the width of the solid head 33 in the direction orthogonal to the longitudinal direction and the rising direction from the tips to the middle portion toward the photosensitive drum 52 side, gradually decreases from the tips toward the photosensitive drum 52 side, and is set to a uniform width substantially equal to the width of the solid head 33 from the middle portion.

As illustrated in FIG. 15, when the image forming unit 13 is inserted from the insertion port 21*a*, the tips of the pair of plate-like portions 53*a* overlap at least the tips of the holders 42 of the solid head 33 in the direction orthogonal to the longitudinal direction and the elevating direction of the solid head 33. In other words, as illustrated in FIG. 15, when the image forming unit 13 is inserted from the insertion port 21*a*, the tips of the pair of plate-like portions 53*a* face at least the tips of the holder 42 of the solid head 33 that is lowered to the base 31 side in the rising direction of the solid head 33 in a direction orthogonal to the longitudinal direction and the elevating direction of the solid head 33.

The protruding body 54 is a so-called dowel. The protruding body 54 is, for example, a protrusion provided on the drum case 51. For example, the protruding body 54 is formed in a columnar shape, and the ridge portion at the tip thereof is chamfered by an annular flat surface or a curved surface, or the tip thereof is reduced in diameter. The protruding body 54 is adjacent to both ends of the second guide 53 in the axial direction of the photosensitive drum 52. The protruding body 54 is inserted into the opening 41*a* provided in the print head 41. The protruding body 54 is inserted into the opening 41*a*, thereby positioning the position of the photosensitive drum 52 supported by the drum case 51 in the longitudinal direction with respect to the solid head 33. The protruding body 54 is inserted into the opening 41*a*, thereby restricting the movement of the drum case 51 in the X-direction and fixing the image forming unit 13 to the frame 11 and the solid head unit 12.

The spacers 55 are provided in the drum case 51. For example, the spacers 55 are disposed between the photosensitive drum 52 and the print head 41. As illustrated in FIGS. 13 and 14, the spacers 55 are disposed, for example, at positions facing both end sides in the X-direction of the photosensitive drum 52. The spacers 55 generate a gap between the photosensitive drum 52 that is a photosensitive member and the print head 41 of the solid head 33 so that the photosensitive drum 52 and the print head 41 have a positional relationship suitable for the image forming process. For example, when a part of the upper end of the print head 41 comes into contact with the spacer 55 and applies a certain load to the spacer 55, the gap between the photosensitive drum 52 and the print head 41 becomes a desired gap.

The developing roller supplies the toner stored in the toner tank to the surface of the photosensitive drum 52. The charging unit forms uniform charges on the surface of the photosensitive drum 52. The toner tank contains the toner. The cleaner case recovers the excess toner when the toner is adhered to the photosensitive drum 52.

The storage tray 14 stores paper sheets such as paper or film on which printing or the like is performed. The storage tray 14 is disposed below the frame 11, for example, below the plurality of solid head units 12 and the plurality of image forming units 13. The storage tray 14 includes a pickup roller, and corresponding paper sheets are picked up according to the image forming process. The picked-up paper sheets are conveyed to the image forming unit 13 and the transfer belt 16 by a conveyance device or the like.

The scanner unit 15 reads a disposed document or the like. The scanner unit 15 includes, for example, a manual feed tray 15*a*.

The transfer belt 16 transfers the toner adhered to the electrostatic latent image on the photosensitive drum 52 to the paper sheet passing through the photosensitive drum 52. The fixing device 17 fixes the toner on the paper sheet to which the toner is transferred.

The paper discharge tray 18 receives the discharged paper sheets after the toner is fixed thereon.

The conveyance device conveys the paper sheets from the storage tray 14 to the paper discharge tray 18. For example, the conveyance device is constituted by a plurality of rollers provided in the frame 11 and a drive device that rotates the rollers. In FIGS. 1 and 2, the paper discharge tray 18 is illustrated with a decorative plate omitted.

The control unit controls each configuration and performs an image forming process. As examples of the image forming process, for example, a charging process for controlling the charging unit to form uniform charges on the photosensitive drum 52 of the image forming unit 13, an exposure process for controlling the solid head unit 12 to form an electrostatic latent image on the photosensitive drum 52, a developing process for adhering toner to the electrostatic latent image on the photosensitive drum 52, a transfer process for transferring the toner adhered to the electrostatic latent image to the paper sheet passing through the photosensitive drum 52 by the transfer belt 16 or the like, and a fixing process for fixing the toner on the paper sheet to which the toner is transferred by the fixing device 17 are included.

Next, as an example of attaching and detaching of the image forming unit 13 of the image forming apparatus 1 configured as described above, an example of a replacing activity of the image forming unit 13 will be described below. For example, since the toner is a consumable item, the image forming unit 13 is replaced when the toner is consumed. As another example of attaching and detaching of the image forming unit 13, the image forming unit 13 may be temporarily detached from the image forming apparatus 1 when the solid head 33 is cleaned.

First, as illustrated in FIGS. 10 and 11, the operator operates the operation lever 32*a* of the solid head unit 12 to which the image forming unit 13 to be detached is attached. Specifically, when the operator rotates the operation portion 32*a*1 of the solid head unit 12 in the direction indicated by the arrow in FIG. 17, the shaft portion 32*a*2 rotates following the rotation of the operation portion 32*a*1. When the shaft portion 32*a*2 rotates, the protrusion 32*b*1 provided on the shaft portion 32*a*2 illustrated in FIG. 19 moves along the groove 32*b*2 of the cylindrical body 32*b*3 as illustrated in FIG. 18, and the shaft portion 32*a*2 moves from the rear side to the front side along the X-direction in addition to the movement in the rotation direction.

When the shaft portion 32*a*2 moves in the X-direction, the slider 32*c* fixed to the shaft portion 32*a*2 also moves along the X-direction. When the slider 32*c* moves from the rear side to the front side along the X-direction, the support member 32*e* and the link body 32*f*2 rotationally move and the solid head 33 is lowered toward the base 31.

Specifically, when the slider 32*c* moves from the rear side to the front side along the X-direction, the second shafts 32*f*3 rotatably supported by the slider 32*c* also move from the rear side to the front side along the X-direction. By the movement of one second shaft 32*f*3, the support member 32*e* rotates toward the base 31 around the axis of the end portion on the base 31 side. By the rotation of the support member 32*e*, the first shaft 32*f*1 moves from the rear side to the front side in the X-direction, and moves from the upper side to the lower side in the Z-direction. Therefore, the link body 32*f*2 rotates around the first shaft 32*f*1 in a direction along the X-direction, and the other second shaft 32*f*3 connected to the solid head 33 moves downward. Therefore, the solid head 33 connected to the other second shaft 32*f*3 is lowered toward the base 31.

When the solid head 33 is lowered toward the base 31, the protruding body 54 of the image forming unit 13 which is inserted into the opening 41*a* of the print head 41 comes out of the opening 41*a* as illustrated in FIGS. 12 to 15. With this configuration, the restriction in the X-direction of the image forming unit 13 is released.

Next, the operator pulls out the image forming unit 13 along the X-direction. By this operation, the image forming unit 13 is guided by the first guide 34 and moves in the X-direction. That is, the supported portion 51*a* and the guiding portion 51*b* of the drum case 51 are separated from the support hole 22*a* and the guide hole 22*b* of the rear frame 22, respectively, and the drum case 51 moves in the X-direction while being abutted on the first guide 34. Then, as illustrated in FIG. 4, the image forming unit 13 is pulled out from the insertion port 21*a* of the front frame 21.

Next, the operator inserts a new image forming unit 13 for replacement from the insertion port 21*a* as illustrated in FIG. 5 in the state where the solid head 33 is lowered to the base 31 side as illustrated in FIG. 16. In the image forming unit 13 inserted from the insertion port 21*a*, first, as illustrated in FIG. 5, the drum case 51 abuts on the first guide 34 and moves in the X-direction along the first guide 34. In this case, as illustrated in FIG. 15, the tip of the holder 42 of the solid head 33 is overlapped with the tip of the second guide 53 of the image forming unit 13. In other words, the tip of the holder 42 of the solid head 33 is in a state of facing the tip of the second guide 53 in the direction orthogonal to the X-direction and the elevating direction of the solid head 33.

For that reason, when the drum case 51 abuts on the first guide 34 and moves in the X-direction, if the image forming unit 13 is deviated from a predetermined position in the direction orthogonal to the X-direction and the elevating direction of the solid head 33, the second guide 53 abuts on the holder 43. Therefore, the position of the solid head 33 with respect to the image forming unit 13 in the direction, which is orthogonal to the X-direction and the elevating direction of the solid head 33 when the image forming unit 13 is inserted, is guided by the second guide 53 and the holder 42.

Furthermore, when the image forming unit 13 is inserted, the supported portion 51*a* and the guiding portion 51*b* of the drum case 51 are inserted into the support hole 22*a* and the guide hole 22*b* of the rear frame 22. With this configuration, the image forming unit 13 is supported by the rear frame 22 and the solid head unit 12.

In this case, the posture of the image forming unit 13 around the central axis of the supported portion 51*a* is determined by the guiding portion 51*b* inserted into the guide hole 22*b*. The position of the image forming unit 13 in the direction orthogonal to the insertion direction of the image forming unit 13 and the elevating direction of the solid head 33 is guided by the holder 42 and the second guide 53. Therefore, the pair of protruding bodies 54 provided in the image forming unit 13 faces the pair of openings 41*a* formed in the print head 41 of the solid head 33.

Next, the operator operates the operation lever 32*a* to raise the solid head 33 with respect to the base 31. Specifically, when the operator rotates the operation portion 32*a*1 in the direction of the arrow illustrated in FIG. 16, the shaft portion 32*a*2 rotates following the rotation of the operation portion 32*a*1. When the shaft portion 32*a*2 rotates, the protrusion 32*b*1 provided on the shaft portion 32*a*2 illustrated in FIG. 18 moves along the groove 32*b*2 of the cylindrical body 32*b*3 as illustrated in FIG. 19, and the shaft portion 32*a*2 moves from the front side to the rear side along the X-direction in addition to the movement in the rotation direction.

When the shaft portion 32*a*2 moves in the X-direction, the slider 32*c* fixed to the shaft portion 32*a*2 also moves along the X-direction. When the slider 32*c* moves from the front side to the rear side along the X-direction, the support member 32*e* and the link body 32*f*2 rotationally move.

Specifically, when the slider 32*c* moves from the front side to the rear side along the X-direction, the second shafts 32*f*3 rotatably supported by the slider 32*c* also move from the front side to the rear side along the X-direction. By the movement of one second shaft 32*f*3, the support member 32*e* rotates in the direction away from the base 31 around the axis at the end portion on the base 31 side. By the rotation of the support member 32*e*, the first shaft 32*f*1 moves from the front side to the rear side in the X-direction, and moves from the lower side to the upper side in the Z-direction. The link body 32*f*2 rotates around the first shaft 32*f*1 in the direction in which the inclination angle becomes larger with respect to the X-direction, and as a result, the other second shaft 32*f*3 connected to the solid head 33 moves upward. With this configuration, the solid head 33 connected to the other second shaft 32*f*3 rises in a direction away from the base 31.

Therefore, the solid head 33 rises in the second guide 53 toward the photosensitive drum 52. In this case, since the holder 42 moves between the pair of plate-like portions 53*a* of the second guide 53, the solid head 33 is guided to a predetermined position in the direction orthogonal to the insertion direction of the image forming unit 13 of the holder 42 and the elevating direction of the solid head 33.

Then, the solid head 33 is raised and the protruding body 54 is inserted into the opening 41*a* of the print head 41, and, for example, the print head 41 abuts on the drum case 51 or the photosensitive drum 52. With this configuration, the image forming unit 13 is restricted from moving in the X-direction, and is fixed to the frame 11 and the solid head unit 12. The solid head 33 is aligned with the photosensitive drum 52 at a predetermined position suitable for the image forming process. The print head 41 is constantly urged toward the photosensitive drum 52 by the urging member 43 and is held at a predetermined position with respect to the photosensitive drum 52.

According to the image forming apparatus 1 including the image forming unit 13 configured as described above, the second guide 53 is provided in the drum case 51 of the image forming unit 13. The second guide 53 guides the position of the solid head 33 for the image forming unit 13 in the direction orthogonal to the insertion direction of the image forming unit 13 and the elevating direction of the solid head 33 when the image forming unit 13 is inserted from the insertion port 21*a*. The second guide 53 guides the position of the solid head 33 in the direction orthogonal to the insertion direction of the image forming unit 13 and the elevating direction of the solid head 33 when the solid head 33 is raised. Therefore, the image forming unit 13 can guide the relative position of the solid head 33 and the photosensitive drum 52 to the predetermined position suitable for the image forming process.

The image forming unit 13 can align the protruding body 54 of the image forming unit 13 with the opening 41*a* of the solid head 33 by the second guide 53 guiding the relative position of the solid head 33 and the image forming unit 13. Therefore, the work of mounting the image forming unit 13 on the image forming apparatus 1 may include work such as inserting the image forming unit 13 until the supported portion 51*a* and the guiding portion 51*b* of the image forming unit 13 are disposed in the support hole 22*a* and the guide hole 22*b* of the rear frame 22, and then operating the operation lever 32*a*. As a result, the image forming unit 13 can be easily mounted to the solid head unit 12.

For the purpose of improving mountability, a dimensional difference is provided in dimensions of the insertion port 21*a*, the support hole 22*a*, and the guide hole 22*b* of the frame 11, the first guide 34, the solid head unit 12, and the image forming unit 13. However, the second guide 53 guides the position of the solid head 33 with respect to the image forming unit 13 when the image forming unit 13 is inserted, and guides the position of the solid head 33 with respect to the photosensitive drum 52 of the image forming unit 13 when the solid head 33 is raised. For that reason, in order to improve mountability, the relative position of the solid head 33 and the photosensitive drum 52 can be guided to a position suitable for the image forming process even if the dimensional difference is provided in the dimension of each configuration.

Each link 32*f* is configured to include a pair of the first shafts 32*f*1, a pair of the link bodies 32*f*2, and a pair of the two second shafts 32*f*3. Such a link 32*f* is provided at two locations in the X-direction. The two links 32*f* are connected to the slider 32*c*, the support member 32*e*, and the solid head 33 by a double-supported structure. Therefore, force is stably transmitted to the link 32*f* by the slider 32*c* moving through the conversion mechanism 32*b* by the rotation of the operation lever 32*a*, and the force is stably transmitted to the holder 42 by the rotation of the link 32*f*.

Since the force for raising and lowering the holder 42 is uniformly transmitted through the holes 42*a* at four locations provided in the holder 42, the load applied to the spacer 55 by the print head 41 supported by the holder 42 is stabilized. That is, it is possible to reduce variations in the load on the spacer 55, and the gap between the photosensitive drum 52 and the print head 41 becomes a desired gap. Therefore, the relative position of the solid head 33 and the photosensitive drum 52 can be set to a positional relationship suitable for the image forming process.

Further, the elevating mechanism 32 is configured to move the slider 32*c* linearly by moving the protrusion 32*b*1 through the spirally extending groove 32*b*2, and to rotate the link 32*f* by the movement of the slider 32*c* to raise and lower the solid head 33. With this configuration, the elevating mechanism 32 can reduce a movement amount (stroke amount) of the operation lever 32*a* and the slider 32*c* along the X-direction.

This effect will be described with reference to FIGS. 27 and 28. In FIGS. 27 and 28, L1 to L4 are illustrated. L1 is the center position of the second shaft 32*f*3 connected to the slider 32*c* when the solid head 33 is raised. L2 is the center position of the second shaft 32*f*3 connected to the slider 32*c* when the solid head 33 is lowered. L3 is the position of upper surface of the print head 41 when the solid head 33 is raised. L4 is the position of upper surface of the print head 41 when the solid head 33 is lowered. The width between L1 and L2 is the stroke amount of the slider 32*c*. The width between L3 and L4 is an elevation amount of the solid head 33. For example, in the example of FIGS. 27 and 28, the stroke amount of the slider 32*c* is set to about 5 mm.

The elevating mechanism 32 converts the rotation of the operation lever 32*a* into a linear movement by the conversion mechanism 32*b* and moves the slider 32*c* linearly. Furthermore, the linear movement of the slider 32*c* is converted into a further rotating movement by the link 32*f* and the support member 32*e*, and the solid head 33 connected to the link 32*f* is raised. Therefore, the stroke amount of the slider 32*c* can be set to be smaller than the elevation amount of the solid head 33.

In other words, the elevating mechanism 32 can set the elevation amount of the solid head 33 to be larger than the stroke amount even if the stroke amount of the slider 32*c* is set smaller. Since the rotation of the operation lever 32*a* can be converted into a linear force by the conversion mechanism 32*b*, the operation of the elevating mechanism 32 becomes easy. The movement distance in the X-direction required for operating the operation lever 32*a* may be the same as the stroke amount of the slider 32*c*. Therefore, the work space required on the front side of the image forming apparatus 1 for the operation of the operation lever 32*a* can be minimized.

As described above, with the image forming unit 13 and the image forming apparatus 1 according to at least one embodiment, the relative positional relationship between the solid head 33 and the image forming unit 13 can be guided.

The embodiment is not limited to the example described above. For example, in the example described above, as a configuration for raising and lowering the solid head 33 with respect to the photosensitive drum 52, the configuration using the slider 32*c* that moves linearly by the rotation of the operation lever 32*a* and the link 32*f* that rotates by moving the slider 32*c* to raise and lower the solid head 33 is described, but the embodiment is not limited thereto.

In the example described above, the configuration in which the image forming unit 13 is disposed above the solid head unit 12 is described, but the embodiment is not limited thereto. For example, a configuration in which the image forming unit 13 is disposed below the solid head unit 12 may be adopted.

In the example described above, the configuration in which the opening 41*a* is provided in the print head 41 of the solid head 33 and the protruding body 54 inserted into the opening 41*a* is provided in the drum case 51 is described, but the embodiment is not limited thereto. For example, a configuration in which the opening 41*a* is provided in the holder 42 of the solid head 33 may be adopted. A configuration in which the opening 41*a* is provided in the image forming unit 13 and the protruding body 54 is provided in the solid head 33 may be adopted.

In the example described above, the example in which the second guide 53 is constituted by the pair of plate-like portions 53*a* is described, but the embodiment is not limited thereto. That is, if the position of the solid head 33 with respect to the image forming unit 13 in the direction orthogonal to the X-direction and the elevating direction of the solid head 33 can be guided when the image forming unit 13 is inserted in the X-direction, and if the position of the solid head 33 in the direction orthogonal to the X-direction and the elevating direction of the solid head 33 can be guided when the solid head 33 moves (rises) toward the photosensitive drum 52, the shape of the second guide 53 and the like can be appropriately set. For example, the pair of plate-like portions 53*a* constituting the second guide 53 may be configured to have a notch in addition to a portion facing the holder that supports both ends of the print head 41 of the solid head 33 in the longitudinal direction.

In the example described above, the configuration in which the groove 32*b*2 provided in the cylindrical body 32*b*3 of the conversion mechanism 32*b* is an opening provided in the peripheral surface of the cylindrical body 32*b*3 is described, but the embodiment is not limited thereto. That is, the groove 32*b*2 only needs to be able to guide the protrusion 32*b*1. For example, the groove 32*b*2 may be a groove provided at a predetermined depth on the inner peripheral surface of the cylindrical body 32*b*3 without opening to the peripheral surface of the cylindrical body 32*b*3, or may have another configuration.

The image forming apparatus 1 may be configured to use only a black toner, for example, and may be configured to include one solid head unit 12 and one image forming unit 13. The image forming apparatus 1 may be configured to include other configurations and processes in addition to the configurations and processes described above.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming unit insertable into an image forming apparatus, the image forming unit comprising:

a photosensitive drum configured to be disposed at a predetermined position with respect to a solid head; and a drum case structured to support the photosensitive drum, the drum case including a guide configured to (i) at least partially engage with the solid head of the image forming apparatus when inserted into the image forming apparatus along a first direction and (ii) guide the solid head in a second direction orthogonal to the first direction when the solid head is selectively repositioned along the second direction toward the photosensitive drum, the guide including (i) a first portion configured to engage with the solid head when the solid head is in a first position spaced from the photosensitive drum and (ii) a second portion configured to engage with the solid head when the solid head is in a second position proximate the photosensitive drum, the first portion having a non-uniform width that is larger than a width of the solid head, and the second portion having a uniform width that is substantially the same as the width of the solid head.

2. The image forming unit of claim 1, wherein the non-uniform width gradually decreases between tips of the first portion to the second portion.

3. The image forming unit of claim 1, wherein, when the solid head is in the first position spaced from the photosensitive drum and the image forming unit is inserted into the image forming apparatus, tips of the first portion overlap at least a portion of the solid head.

4. The image forming unit of claim 1, further comprising a protrusion extending from the drum case, the protrusion positioned to engage an opening defined by the solid head.

5. The image forming unit of claim 1, further comprising an elevating mechanism that is configured to facilitate repositioning the solid head between a first position and a second position along the second direction.

6. The image forming unit of claim 5, wherein the elevating mechanism includes:

a lever;

a shaft extending from the lever;

a protrusion extending radially from an outer peripheral surface of the shaft;

a cylindrical body that includes a spiral groove in which the protrusion is movable;

a slider that is connected to the cylindrical body and moves linearly in the first direction; and a link extending between the slider and the solid head, the link configured to convert movement of the slider along the first direction to movement of the solid head in the second direction between the first position and the second position.

7. An image forming apparatus comprising:

a frame;

a solid head unit including:

a base coupled to the frame;

a solid head; and an elevating mechanism configured to facilitate repositioning the solid head with respect to the base in a first direction from a first position to a second position; and an image forming unit including:

a photosensitive drum disposed at a predetermined position with respect to the solid head; and a drum case supporting the photosensitive drum, the drum case including a guide positioned to (i) engage with a portion of the solid head unit when the image forming unit is inserted into the frame along a second direction orthogonal to the first direction and with the solid head in the first position and (ii) guide the solid head when the solid head is selectively repositioned from the first position to the second position along the first direction toward the photosensitive drum, the guide including (i) a first portion configured to engage with the solid head when the solid head is in the first position spaced from the photosensitive drum and (ii) a second portion configured to engage with the solid head when the solid head is in the second position proximate the photosensitive drum, the first portion having a non-uniform width that is larger than a width of the solid head, and the second portion having a uniform width that is substantially the same as the width of the solid head.

8. The image forming apparatus of claim 7, wherein the non-uniform width gradually decreases between tips of the first portion to the second portion.

9. The image forming apparatus of claim 7, wherein, when the solid head is in the first position spaced from the photosensitive drum and the image forming unit is inserted into the image forming apparatus, tips of the first portion overlap at least a portion of the solid head.

10. The image forming apparatus of claim 7, wherein the drum case includes a protrusion extending therefrom, and wherein the solid head defines an opening positioned to receive the protrusion when the solid head is in the second position.

11. The image forming apparatus of claim 7, wherein the solid head includes a protrusion extending therefrom, and wherein the drum case defines an opening positioned to receive the protrusion when the solid head is in the second position.

12. The image forming apparatus of claim 7, wherein the elevating mechanism includes:

a slider supported by the base and linearly translatable in the second direction; and a link extending between the slider and the solid head, the link positioned to convert movement of the slider along the second direction to movement of the solid head in the first direction between the first position and the second position.

13. The image forming apparatus of claim 12, wherein the elevating mechanism includes:

a lever; and a shaft extending from the lever and coupled to the slider, wherein rotation of the lever causes the shaft to rotate and translate in the second direction.

14. The image forming apparatus of claim 13, wherein the shaft includes a protrusion extending radially from an outer peripheral surface thereof, and wherein the elevating mechanism includes a cylindrical body that includes a spiral groove in which the protrusion is movable.

15. An image forming apparatus comprising:

a frame;

a solid head unit including:

a base coupled to the frame;

a solid head; and an elevating mechanism configured to facilitate repositioning the solid head with respect to the base in a first direction from a first position to a second position; and an image forming unit including:

a photosensitive drum disposed at a predetermined position with respect to the solid head; and a drum case supporting the photosensitive drum, the drum case including a guide positioned to (i) engage with a portion of the solid head unit when the image forming unit is inserted into the frame along a second direction orthogonal to the first direction and with the solid head in the first position and (ii) guide the solid head when the solid head is selectively repositioned from the first position to the second position along the first direction toward the photosensitive drum, the guide including (i) a first portion configured to engage with the solid head when the solid head is in the first position spaced from the photosensitive drum, and (ii) a second portion configured to engage with the solid head when the solid head is in the second position proximate the photosensitive drum, the first portion having a non-uniform width that is larger than a width of the solid head, and the second portion having a uniform width.

16. The image forming apparatus of claim 15, wherein the non-uniform width gradually decreases between tips of the first portion to the second portion.

17. The image forming apparatus of claim 15, wherein, when the solid head is in the first position spaced from the photosensitive drum and the image forming unit is inserted into the image forming apparatus, tips of the first portion overlap at least a portion of the solid head.

18. The image forming apparatus of claim 17, wherein the drum case includes a protrusion extending therefrom, and wherein the solid head defines an opening positioned to receive the protrusion when the solid head is in the second position.

19. The image forming apparatus of claim 15, wherein the solid head includes a protrusion extending therefrom, and wherein the drum case defines an opening positioned to receive the protrusion when the solid head is in the second position.

20. The image forming apparatus of claim 15, wherein the elevating mechanism includes:

a slider supported by the base and linearly translatable in the second direction; and a link extending between the slider and the solid head, the link positioned to convert movement of the slider along the second direction to movement of the solid head in the first direction between the first position and the second position.

* * * * *